US009776219B2

(12) United States Patent
Whelan et al.

(10) Patent No.: US 9,776,219 B2
(45) Date of Patent: Oct. 3, 2017

(54) METHOD AND APPARATUS FOR REMOVING BIOFOULING FROM A PROTECTED SURFACE IN A LIQUID ENVIRONMENT

(71) Applicant: Raytheon Company, Waltham, MA (US)

(72) Inventors: Colin S. Whelan, Wakefield, MA (US); Matthew D. Thoren, Tyngsboro, MA (US); Andrew M. Piper, Nashua, NH (US); Joseph C. DiMare, Somerville, MA (US)

(73) Assignee: Raytheon Company, Waltham, MA (US)

( * ) Notice: Subject to any disclaimer, the term of this patent is extended or adjusted under 35 U.S.C. 154(b) by 1297 days.

(21) Appl. No.: 13/743,906

(22) Filed: Jan. 17, 2013

(65) Prior Publication Data

US 2014/0196745 A1 Jul. 17, 2014

(51) Int. Cl.

| | |
|---|---|
| ***B08B 7/00*** | (2006.01) |
| ***B08B 17/02*** | (2006.01) |
| ***B63B 59/04*** | (2006.01) |
| ***B63B 59/08*** | (2006.01) |

(52) U.S. Cl.

CPC ..... *B08B 7/0057* (2013.01); *B08B 17/02* (2013.01); *B63B 59/04* (2013.01); *B63B 59/08* (2013.01)

(58) Field of Classification Search

None

See application file for complete search history.

(56) References Cited

U.S. PATENT DOCUMENTS

| | | | | |
|---|---|---|---|---|
| 2,189,279 | A | 2/1940 | Bitner | |
| 3,924,139 | A | 12/1975 | Hirose et al. | |
| 3,971,388 | A | 7/1976 | Cowdery | |
| 4,204,956 | A | 5/1980 | Flatow | |
| 4,234,907 | A * | 11/1980 | Daniel | A41D 27/085 139/420 R |
| 4,255,383 | A | 3/1981 | Schenck | |
| 4,296,066 | A | 10/1981 | Schenck | |
| 4,317,041 | A | 2/1982 | Schenck | |
| 4,320,085 | A | 3/1982 | Takeguchi et al. | |
| 4,372,860 | A | 2/1983 | Kaas | |

(Continued)

FOREIGN PATENT DOCUMENTS

| | | | |
|---|---|---|---|
| FR | 2 875 718 | 3/2006 | |
| NO | WO 2011095531 A1 * | 8/2011 | B08B 3/024 |

(Continued)

OTHER PUBLICATIONS

Sangermano et al.; "Degradable Epoxy Coatings by Photoinitiated Cationic Copolymerization of Biseposide with ϵ-caprolactone;" European Polymer Journal 46; Oct. 29, 2009; pp. 254-259.

(Continued)

*Primary Examiner* — Nicole Blan

(74) *Attorney, Agent, or Firm* — Daly, Crowley, Mofford & Durkee, LLP

(57) ABSTRACT

A system includes a UV light source and an optical medium coupled to receive UV light from the UV light source. The optical medium is configured to emit UV light proximate to a surface from which biofouling is to be removed once the biofouling has adhered to the protected surface. A method corresponds to the system.

25 Claims, 15 Drawing Sheets

(56) References Cited

U.S. PATENT DOCUMENTS

| | | | | |
|---|---|---|---|---|
| 4,471,225 | A | 9/1984 | Hillman | |
| 4,525,278 | A | 6/1985 | Frost, III | |
| 4,548,716 | A | 10/1985 | Boeve | |
| 4,689,523 | A | 8/1987 | Fowler | |
| 4,752,401 | A | 6/1988 | Bodenstein | |
| 4,762,613 | A | 8/1988 | Snowball | |
| 4,778,653 | A | 10/1988 | Kamimura et al. | |
| 4,948,980 | A | 8/1990 | Wedekamp | |
| 5,308,505 | A | 5/1994 | Titus et al. | |
| 5,322,569 | A * | 6/1994 | Titus | A61L 2/0011 134/1 |
| 5,354,603 | A | 10/1994 | Errede et al. | |
| 5,673,341 | A | 9/1997 | Takesue et al. | |
| 5,929,453 | A | 7/1999 | Andrews et al. | |
| 5,935,431 | A | 8/1999 | Korin | |
| 6,108,454 | A | 8/2000 | Nevis et al. | |
| 6,607,826 | B1 * | 8/2003 | Hatch | B32B 3/10 106/15.05 |
| 6,759,664 | B2 | 7/2004 | Thompson et al. | |
| 6,831,876 | B1 | 12/2004 | Cartwright | |
| 7,175,807 | B1 | 2/2007 | Jones | |
| 7,387,454 | B2 | 6/2008 | Kikuchi et al. | |
| 7,598,501 | B2 | 10/2009 | Jones | |
| 7,903,919 | B2 | 3/2011 | Mukasa | |
| 7,953,326 | B2 | 5/2011 | Farr et al. | |
| 2003/0024863 | A1 | 2/2003 | Gannon et al. | |
| 2003/0151739 | A1 | 8/2003 | Capaldo et al. | |
| 2005/0007448 | A1 | 1/2005 | Kaltenbacher et al. | |
| 2007/0102359 | A1 | 5/2007 | Lombardi et al. | |
| 2007/0170347 | A1 | 7/2007 | Fournier et al. | |
| 2007/0287766 | A1 * | 12/2007 | Kuczynski | C09D 5/008 523/124 |
| 2008/0068926 | A1 | 3/2008 | Chambers et al. | |
| 2008/0211643 | A1 | 9/2008 | Mohr et al. | |
| 2008/0246485 | A1 | 10/2008 | Hibbs et al. | |
| 2009/0000188 | A1 | 1/2009 | Sayers et al. | |
| 2009/0192921 | A1 | 7/2009 | Hicks | |
| 2009/0194708 | A1 | 8/2009 | Studer et al. | |
| 2010/0044321 | A1 | 2/2010 | Vestergaard Frandsen | |
| 2010/0176056 | A1 | 7/2010 | Rozenberg | |
| 2011/0056276 | A1 | 3/2011 | Scott et al. | |
| 2012/0050520 | A1 | 3/2012 | Thoren et al. | |
| 2012/0317750 | A1 | 12/2012 | Ostervold et al. | |

FOREIGN PATENT DOCUMENTS

| | | |
|---|---|---|
| WO | WO 2005/077556 | 8/2005 |
| WO | WO 2008/125339 A2 | 10/2008 |
| WO | WO 2008/125339 A3 | 10/2008 |
| WO | WO 2008/144922 A1 | 12/2008 |

OTHER PUBLICATIONS

PCT Search Report and Written Opinion of the ISA dated Mar. 25, 2014; for PCT Pat. App. No. PCT/US2013/076455; 11 pages.
U.S. Appl. No. 13/218,621, filed Aug. 26, 2011, Thoren.
Emirhan; "Fiber Optics in Textile;" 3rd International Symposium of Interactive Media Design: Istanbul, Turkey; Jan. 5-7, 2005; 6 sheets.
PCT Search Report and Written Opinion of the ISA; for PCT Pat. App. No. PCT/US2011/046712; 18 pages.
PCT Invitation to Pay Additional Fees with Partial PCT Search Report of the ISA; dated PCT/US2011/046712 dated Dec. 23, 2011.
PCT Search Report and Written Opinion of the ISA; dated Nov. 7, 2012; for PCT Pat. App. No. PCT/US2012/047906; 12 pages.
Notice of Allowance dated Aug. 27, 2012; for U.S. Appl. No. 13/218,621; 14 pages.
Notice of Allowance; dated Jan. 9, 2013; for U.S. Appl. No. 13/218,621; 11 pages.
Office Action dated Jan. 15, 2013; for U.S. Appl. No. 12/862,084; 27 pages.
Final Office Action; dated May 6, 2013; for U.S. Appl. No. 12/862,084; 31 pages.
PCT International Preliminary Report on Patentability and Written Opinion of the ISA dated Jul. 30, 2015; for PCT Pat. App. No. PCT/US2013/075455; 7 pages.
PCT International Preliminary Report on Patentability dated Mar. 13, 2014; for PCT Pat. App. No. PCT/US2012/047906; 9 pages.
PCT International Preliminary Report on Patentability and Written Opinion of the ISA; dated Mar. 7, 2013; for PCT Pat. App. No. PCT/US2011/046712; 13 pages.
Response to Office Action; dated Jan. 15, 2013; for U.S. Appl. No. 12/862,084p 16 pages.

* cited by examiner

METHOD AND APPARATUS FOR REMOVING BIOFOULING FROM A PROTECTED SURFACE IN A LIQUID ENVIRONMENT

FIELD OF THE INVENTION

This invention relates generally to apparatus for removing biofouling and, more particularly, to an apparatus for removing biological material from a surface, for example, a ship hull, immersed in a liquid, for example, the ocean.

BACKGROUND OF THE INVENTION

Underwater objects, particularly underwater objects that are in the water for long periods of time, have external surfaces that are subject to so-called "biofouling." As used herein, the term "biofouling" is used to describe an attachment of organisms that live in the liquid, e.g., in the ocean, to surfaces, particularly to man-made surfaces. The organisms can be small, for example, algae, or larger, for example, barnacles.

Detrimental effects of biofouling to man-made surfaces are well known and wide-ranging. As is known, boats, ships, and other vessels that experience biofouling are subject to increased drag when operating in the water. Performance of underwater optical windows and sensors is also diminished.

As is known, some types of coatings, for example, anti-biofouling paints, can be applied to some surfaces, for example, ship hulls, to prevent or retard biofouling. However, anti-biofouling coatings tend to degrade with time and need to be reapplied, for example, every few years. In order to reapply an anti-biofouling coating, a ship must be put to dry dock for the operation, resulting in high cost and ship down time.

Copper corrosion mechanisms or Tributyltin (TBT) biocide leaching are known. Electro-chlorination systems and automatic acid (e.g. tin dioxide) dispensing systems are also known. These mechanisms require release of chemicals into the water, proximate to the underwater surface, e.g., the ship hull. These mechanisms prevent biofouling on surfaces through localized production of bleach, via an oxidation of chloride ions present in seawater. Although the effects of such chemical systems are temporary, only lasting a few months, the effect on the environment is larger than desired for an anti-biofouling system. Furthermore the chemical release mechanisms are subjected to the ocean environment, e.g., pressure, resulting in reduced reliability.

Ultraviolet (UV) radiation consists of electromagnetic radiation between visible violet light and x-rays, and ranges in wavelength from about 400 nm to about 10 nm. UV is a component (less than 5%) of the sun's radiation and is also produced artificially by arc lamps, e.g., by a mercury arc lamp (or mercury vapor lamp).

Ultraviolet radiation in sunlight is often considered to be divided into three bands. Ultraviolet light in a UVA band (about 320-400 nm) can cause skin damage and may cause melanomatous (skin cancer). Ultraviolet light in a UVB band (about 280-320 nm) is stronger radiation that increases in the summer and is a common cause of sunburn and most common skin cancer. Ultraviolet light in a UVC band (below about 280 nm) is the strongest, having the greatest energy per photon (eV), and is potentially the most harmful form. Photon energy is calculated using: $E=hv=hc/\lambda$, where h is Plancks Constant, c is the speed of light, and $\lambda$ is wavelength. Therefore, the lower the wavelength of electromagnetic radiation, the greater the energy per photon.

Much of the UVB radiation and most of the UVC radiation is absorbed by the ozone layer of the atmosphere before it can reach the earth's surface. Much of the UVB and UVC radiation that does pass through the ozone layer tends to be partially absorbed by ordinary window glass or by impurities in the air (e.g., water, dust, and smoke).

Ultraviolet germicidal irradiation (UVGI) is a sterilization method that uses specific UVC wavelengths (about 260 nm, e.g., 253.7 nm) to break down and kill microorganisms. Wavelengths of UVC radiation at or near 260 nm are known to be effective in destroying nucleic acids in the microorganisms so that their DNA is disrupted. Disruption of the DNA eliminates reproductive capabilities and kills the microorganisms.

U.S. Pat. No. 5,322,569, issued Jun. 21, 1994, describes an ultraviolet generating mechanism that can prevent biofouling underwater by way of a moving ultraviolet light source, and is incorporated by reference herein in its entirety.

It would be desirable to provide means, without using chemicals, to remove biofouling from a surface once the biofouling has formed, the surface disposed in the water. It would be desirable to have such a system that can remove biofouling to a degree that would reduce or eliminate the need to remove the surface, e.g., a surface upon a vessel, from the water.

SUMMARY OF THE INVENTION

The present invention provides a means, without using chemicals, to remove biofouling from a surface once the biofouling has formed, the surface disposed in the water. The present invention provides such a system that can remove biofouling to a degree that would reduce or eliminate the need to remove the surface, e.g., a surface upon a vessel, from the water.

In accordance with one aspect of the present invention, a system for anti-biofouling a protected surface includes an ultraviolet light source; a transmission medium coupled to receive the ultraviolet light and configured to distribute the ultraviolet light upon the protected surface; and a cleaning mechanism proximate to the protected surface and operable to remove biological material from the protected surface.

In accordance with another aspect of the present invention, a system for anti-biofouling a protected surface includes an ultraviolet light source; a transmission medium coupled to receive the ultraviolet light and configured to disburse the ultraviolet light upon the protected surface; and a degradable layer disposed over and mechanically coupled to the protected surface, wherein the degradable layer is disposed to receive the portions of the ultraviolet light that escape the optical medium, wherein the degradable layer is responsive to the ultraviolet light such that selected portions of the degradable layer are configured to change mechanical properties and to be removable in response to the ultraviolet light, facilitating removal of biological material from the protected surface.

In accordance with another aspect of the present invention, a method of anti-biofouling a protected surface includes generating ultraviolet light; distributing the ultraviolet light about the protected surface though a transmission medium; providing a cleaning mechanism proximate to the protected surface; and after the distributing the ultraviolet light upon the degradable layer, using the cleaning mechanism to remove biological material from the protected surface.

In accordance with another aspect of the present invention, a method of anti-biofouling a protected surface includes generating ultraviolet light; providing a degradable layer as an outermost layer of the protected surface; distributing the ultraviolet light about the protected surface though a transmission medium; and distributing the portions of the ultraviolet light upon the degradable layer, wherein portions of the degradable layer are configured to change chemical structure and to be removable once exposed to the ultraviolet light, facilitating removal of biological material from the protected surface.

BRIEF DESCRIPTION OF THE DRAWINGS

The foregoing features of the invention, as well as the invention itself may be more fully understood from the following detailed description of the drawings, in which.

DETAILED DESCRIPTION OF THE INVENTION

Figure 1:
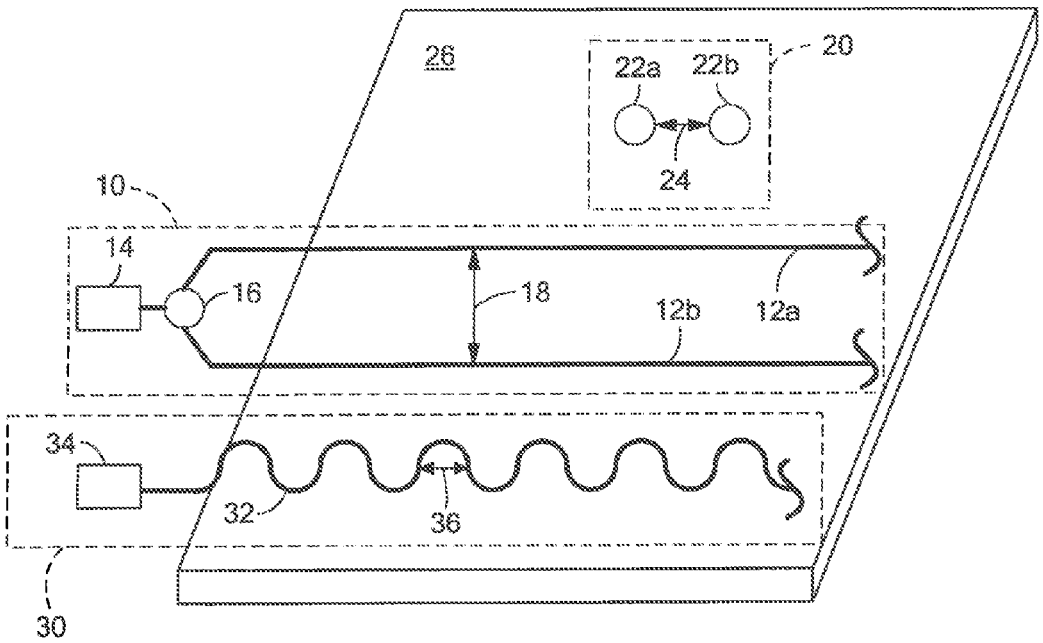
FIG. 1 is a pictorial showing a protected surface with one or two optical fibers and one or two ultraviolet (UV) light emitting diodes (LEDS) disposed thereon.

Before describing the present invention, some introductory concepts and terminology are explained. As used herein, the term "protected surface" refers to a surface disposed in water and upon which organisms attach. Certain layers are described herein to be disposed over the protected surface. However, it will be understood that the protected surface is an outer surface exposed to water, including said layers.

Certain arrangements that can retard of stop growth of biological material upon a protected surface are described in U.S. patent application Ser. No. 13/218,621, entitled "Method and Apparatus for Anti-Biofouling of a Protected Surface in Liquid Environments," filed Aug. 26, 2011, and also in U.S. Patent Application Number, entitled "Method and Apparatus for Anti-Biofouling of Optics in Liquid Environment," filed Aug. 24, 2010, both of which are incorporated by reference herein in their entirety. Both of the above two patent applications describe systems that can prevent biofouling from forming, but do not described how to remove biofouling once formed.

As used herein, the term "optical medium" is used to describe an ultraviolet carrying and/or ultraviolet emitting part of the systems described below. As will become apparent, the optical medium is used to distribute the ultraviolet light to remove organisms from the protected surface even after the organisms have affixed to the protected surface. As will also become apparent, there are many embodiments of the optical medium.

In some embodiments, the optical medium is coupled to receive ultraviolet light from one or more ultraviolet light sources. In some other embodiments, the optical medium is conjoined with one or more ultraviolet light sources.

As used herein, the terms "biological material" and "biological organisms" refers to growth that tends to form on surfaces when immersed in seawater, or alternately, in fresh water. The growth can include, but is not limited to, algae, barnacles, and various forms of bivalves, for example, mussels.

As used herein, the term "ultraviolet light source" is used to describe any emitter of ultraviolet light, including both narrowband ultraviolet light emitters and also broadband ultraviolet light emitters. It will be understood that a broadband ultraviolet light emitter may emit not only ultraviolet light, but also light at other parts of the electromagnetic spectrum, including visible light. Light from the broadband ultraviolet light emitter may or may not be passed through a narrowband optical filter.

As used herein, the term "degradable layer" is used herein to describe a layer that changes mechanical properties in response to ultraviolet light. As described more fully below, at least portions of the degradable layer are easily removable once exposed to the ultraviolet light, and the portions of the degradable layer, before exposure to the ultraviolet light, are less easily removable. Thus, biological material that grows on the degradable layer can be easily removed.

In some embodiments described more fully below, a degradable layer is used in conjunction with an optical medium that can distribute ultraviolet light over the degradable layer. However, in other embodiments, the degradable layer is disposed to receive ultraviolet light without an optical medium, for example, directly through a transmission medium, for example, through air or another gas.

It should be noted that reference is sometimes made herein to assemblies or surfaces having a particular shape (e.g., flat or cylindrical). One of ordinary skill in the art will appreciate, however, that the techniques described herein are applicable to a variety of sizes and shapes.

Referring to FIG. 1, an exemplary system 10 includes an optical medium comprised of two (or more) optical fibers 12*a*, 12*b* coupled through a coupler 16 to receive ultraviolet (UV) light from an ultraviolet light source 14. The UV light source 14 can be any type of UV light source, however, a laser UV light source is preferred. The laser UV light source can be any type of laser UV generator.

UVC radiation for ultraviolet germicidal irradiation (UVGI) is conventionally generated using mercury vapor lamps. In some embodiments the UV light source 14 comprises one or more mercury vapor lamps. In other embodiments, the UV light source 14 comprises one or more UV lasers, for example, excimer lasers. In other embodiments, the UV light source 14 comprises one or more UV light emitting diodes (LEDS).

It will be understood that, in other applications, for example, communications applications, escape of the UV light from the optical fibers 12*a*, 12*b* would be very undesirable. However, in the system 10, the optical fibers 12*a*, 12*b* have special characteristics described more fully below that allow a determined amount of the UV light to escape from the optical fibers along lengths of the optical fibers.

It will be understood that a largest amount of UV power is carried within respective ends of the optical fibers 12*a*, 12*b* closest to the UV light sources 14. Therefore, in some embodiments, the characteristics of the optical fibers that allow UV light to escape are selected to change along lengths of the optical fibers 12*a*, 12*b*. The changing characteristics can be selected to result in a substantially equal amount of UV light escaping at each point down the lengths of the optical fibers 12*a*, 12*b*, even though the UV power within the optical fibers 12*a*, 12*b* may drop down the lengths of the optical fibers 12*a*, 12*b*.

The two optical fibers 12*a*, 12*b* have a selected spacing 18, selected to result in a sufficient intensity of UV light between the two optical fibers to effect growth of biofouling organisms upon a protected surface 26 in the region between the two optical fibers 12*a*, 12*b*, and also in regions adjacent to the optical fibers 12*a*, 12*b*.

The amount of power can correspond to an average intensity of about twenty $\mu W/cm^2$ at any given area along the protected surface. This intensity can result from a combination of multiple light emitting sources. The amount of power emitted per unit length of fiber is directly proportional to the fiber spacing 18. The closer the spacing 18, the less power required per fiber per unit length. For example, a UV source providing three Watts of light will cover, if the light is perfectly coupled to the protected surface, an area of approximately fifteen square meters.

An amount of power generated by the UV light source 14 is selected based upon lengths of the optical fibers 12*a*, 12*b*, upon the spacing 18, and upon a desired lowest amount of UV intensity between the two optical fibers 12*a*, 12*b*. For example, for the two optical fibers 12*a*, 12*b* with lengths of fifty meters, a spacing 18 of one centimeter, and a lowest intensity of UV light equal to about twenty μW per square centimeter between the two optical fibers 12*a*, 12*b*, a total power (per fiber) of the UV light source 14 can be about one hundred milliwatts, or a total intensity of about two milliwatts per meter-centimeter delivered to each one of the two optical fibers 12*a*, 12*b*. This power can be in the range of about fifty to about one hundred fifty milliWatts. This example results in two fibers protecting about one square meter of a protected surface.

In some embodiments, the optical fibers 12*a*, 12*b* transmit UVC light having an intensity resulting in about twenty μW per square centimeter at all points between optical fibers 12*a*, 12*b* and also for regions surrounding each of the optical fibers 12*a*, 12*b*. However, the intensity can be more than or less than twenty μW per square centimeter, for example, within a range of about ten to about thirty μW per square centimeter to prevent biofouling.

While some factors are described above, the intensity of the UVC light can be also selected in accordance with a variety of other factors, for example, a temperature of the water, a type of the water (e.g., fresh or salt water), or a type of organism (e.g., barnacles) for which anti-biofouling is desired.

Another system 20 can include a UV light source comprised of two (or more) UV light emitting diodes (LEDS) 22*a*, 22*b*. The UV LEDS have a spacing 24. Light emitted by the two UV LEDS can have a beamwidth and a power, which, together with the spacing 24 are selected to result in a sufficient intensity of UV light between the two UV LEDS and surrounding the two UV LEDS 22*a*, 22*b* to effect growth of biofouling organisms upon the protected surface 26.

An amount of power generated by each one of the two UV LEDS 22*a*, 22*b* is selected based upon the spacing 24, upon the beamwidth, and upon a desired lowest amount of UV intensity between the two UV LEDS 22*a*, 22*b*. For example, for a beamwidth of about one hundred twenty degrees, a spacing 24 of one centimeter, and a lowest intensity of UV light equal to about twenty μW per square centimeter between the two UV LEDS, a total power of each one of the two UV LEDS 22*a*, 22*b* can be about 200 μW delivered by each one of the two UV LEDS 22*a*, 22*b*. This power can be in the range of about 100 μW to about 300 μW.

The UV LEDs 22*a*, 22*b* are known to have optical beam widths ranging from about zero to about one hundred twenty degrees. In one embodiment, beamwidths of the two UV LEDS 22*a*, 22*b* are about one hundred twenty degrees.

In some embodiments, the UV LEDS 22*a*, 22*b* transmit UVC light having an intensity resulting in about twenty μW per square centimeter at all points between the UV 22*a*, 22*b* and also for regions surrounding each of the two UV LEDS 22*a*, 22*b*. However, the intensity can be more than or less than twenty μW per square centimeter, for example, within a range of about ten to about thirty μW per square centimeter.

As described above for the system 10, while some factors are described above, the intensity of the UVC light can be selected in accordance with a variety of other factors, for example, a temperature of the water, a type of the water (e.g., fresh or salt water), or a type of organism (e.g., barnacles) for which anti-biofouling is desired (e.g., barnacles).

While two optical fibers 12*a*, 12*b* are shown, there can be more than two or fewer than two optical fibers. While two UV LEDS 22*a*, 22*b* are shown, there can be more than two or fewer than two UV LEDS. In general, a larger protected surface 26 will require more optical fibers and/or more UV LEDS, or more UV power, in order to effect growth of biofouling organisms upon the protected surface 26.

Another exemplary system 30 includes an optical medium comprised of one (or more) optical fibers 32 coupled to receive ultraviolet (UV) light from an ultraviolet light source 34. The UV light source 34 can be the same as or similar to the UV light source 14.

The optical fiber 32 can be arranged in a snake pattern with separations having dimensions 36 selected to result in a sufficient intensity of UV light to effect growth of biofouling organisms upon a protected surface 26 in the separations and also outside of the snake pattern.

The amount of power can correspond to an average intensity of about twenty $\mu W/cm^2$ at any given area along the protected surface. The amount of power emitted per unit length of fiber is directly proportional to the dimensions 46. The smaller the dimensions 36, the less power required per fiber per unit length.

The three optical media (the optical fibers and the UV LEDS) can be used separately or in conjunction with each other. In some embodiments, the UV light sources 14, 34 and the UV LEDS 22*a*, 22*b* transmit UVC light having a wavelength of about 254 nm.

Light emitting diodes (LEDs) that can transmit ultraviolet light in the UVA, UVB, and UVC parts of the ultraviolet spectrum are recently available. In particular, UV LEDs (e.g., AlInGaN LEDs) are recently available with appropriate sizes and that can transmit UVC with sufficient intensities and efficiencies to provide the UV light sources 14, 34 or the UV LEDS 22*a*, 22*b*.

Figure 1A:
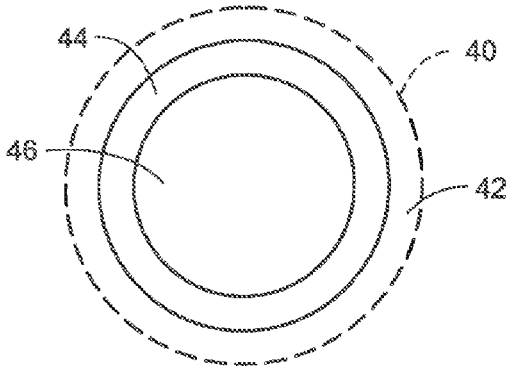
FIG. 1A is a cross section showing a cross-sectional view of an optical fiber.

Referring now to FIG. 1A, an exemplary optical fiber 40 includes at least a core 46 configured to carry ultraviolet light. In some embodiments, the optical fiber 40 also includes a cladding 44 surrounding the core 46. For communication optical fibers, the cladding 44 is configured (i.e., has a suitable index of refraction) to keep the ultraviolet light from escaping the core 46. However, as described more fully below, optical fibers used herein are configured to allow some ultraviolet light carried within the core 46 to escape the optical fiber 40.

The core 46 and the cladding can be comprised of a variety of materials, including, but not limited to, a Silica core with a Silica cladding and a Fluorinated Ethylene Propylene (PEP) core with an Ethylene Tetrafluoroethylene (ETFE) cladding.

In some embodiments, the index of refraction of the core 46 is within the range of about 1.4 to about 1.5 and the index of refraction of the cladding is in a corresponding range of about 1.3 to about 1.4.

In some embodiments, the cladding 44 is not used. In these embodiments, the core 46 can be comprised of a variety of materials, including, but not limited to polymethylpentene (PMP), or polyether ether ketone (PEEK). For example, a TPX® material from Mitsui can be used. With these embodiments, the index or refraction of the core 46 can be about 1.46, but within a range of about 1.4 to about 1.5.

In some conventional communication optical fibers, the optical fiber 40 also includes a jacket 42. The jacket 42 is omitted for exemplary embodiments described herein.

As is known, the core diameter is selected based upon a variety of factors, including, but not limited to a wavelength of the light that travels in the core 46, and a mode of the light that travels in the core 46. It is know that a multi-mode core tends to have a larger diameter than a single mode core.

A variety of core diameters of the core 46 can be used. In some embodiments, the core 46 is a multi-mode core and has a diameter of about three hundred to about six hundred microns.

Figure 2:
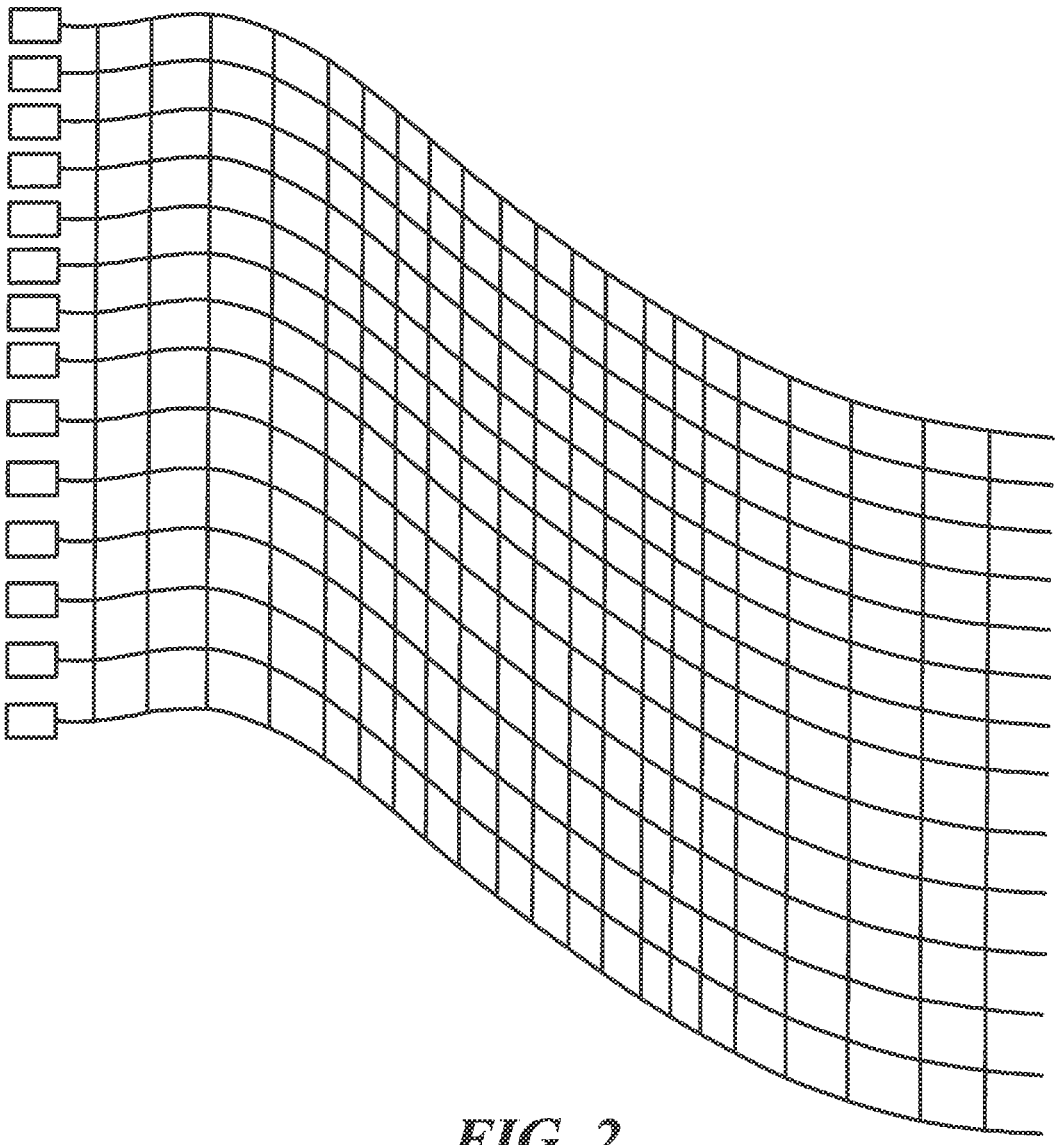
FIG. 2 is a pictorial showing optical fibers woven into a fiberglass mesh, with UV light sources coupled to ends of some of the optical fibers.

Referring now to FIG. 2, an optical medium can include a plurality of optical fibers woven into a mesh, which can be a woven mesh. The mesh can include other fibers that are not optical fibers. Optical fibers are shown as horizontal fibers of the mesh, each optical fiber coupled to receive UV light from a UV light source, shown as a respective box, coupled to transmit UV light into one respective end.

While all of the horizontal fibers of the mesh are each shown to be a respective optical fiber with a respective UV light source, in other embodiments, only some of the horizontal fibers of the mesh are optical fibers.

While none of the vertical fibers of the mesh are shown to be optical fibers, in some other embodiments, all or some of the vertical fibers are optical fibers coupled to other UV light sources (not shown).

While a separate UV light source is shown coupled to each one of the optical fibers, in other embodiments, some or all of the optical fibers can receive UV light from one UV light source through an optical coupler or the like.

While the vertical and horizontal fibers of the mesh are shown to be orthogonally disposed, in other arrangements, the fibers are disposed at other angles, for example, thirty degrees or sixty degrees.

In general, fiberglass meshes, but without optical fibers, are known. In some embodiments, the portions of the mesh that are not optical fibers are comprised of, but are not limited to, glass, Kevlar, Carbon fiber, Vectran, and Aramid. In some embodiments, portions described above to be fibers that are not optical fibers can instead be structural members, for example, metal or composite members.

In other embodiments, the mesh can be comprised of, but is not limited to, an FEP mesh, a PEEK mesh, an ETFE mesh, a PMP mesh, or a THV mesh having the plurality of optical fibers disposed (e.g., woven) therein.

Discussion above in conjunction with FIG. 1 regarding spacings of the optical fibers 12*a*, 12*b*, UV power of light applied to the optical fibers 12*a*, 12*b*, and characteristics of the optical fibers 12*a*, 12*b* that change down lengths of the optical fibers also apply to the optical fibers within the mesh.

The mesh of FIG. 2 can be applied to a surface, for example, to the protected surface 26 of FIG. 1, with a bonding agent, causing the mesh to adhere to the protected surface 26 and to add structural strength and stability to the mesh.

The bonding agent applied to the mesh of FIG. 2 should preferably have UV light stability, i.e., should not change properties with respect to transmission of the UV light. The bonding agent can be comprised of, but is not limited to, a modified acrylic (for example, Loctite 352).

In some embodiments, the mesh of FIG. 2 extends down an entire length of a subsurface part of a ship's hull however, in other embodiments, a plurality of meshes each with their own UV light source(s) can be used to cover the length of the ship's hull.

Figure 3:
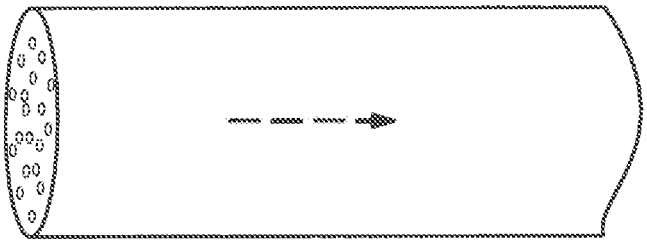
FIG. 3 is a block diagram of an optical fiber having objects, for example, scattering particles, including, but not limited to, air bubbles or nanoparticles, disposed therein.
Figure 3A:
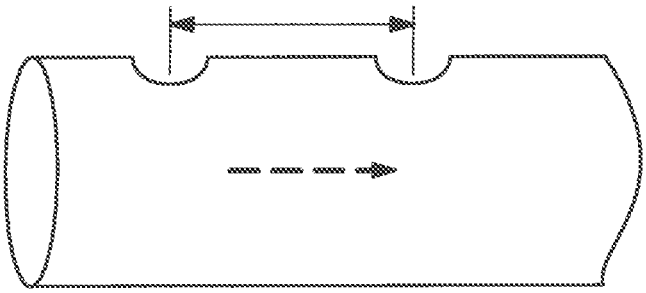
FIG. 3A is a block diagram of another optical fiber having microbends disposed thereon.
Figure 3B:
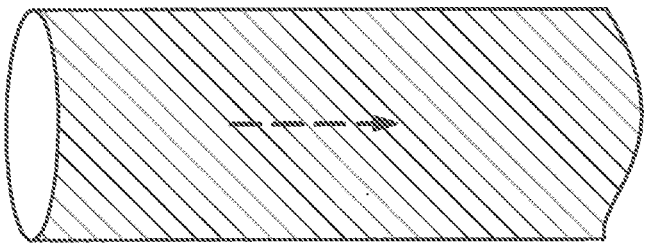
FIG. 3B is a block diagram of another optical fiber having a surface roughness disposed thereon.
Figure 3C:
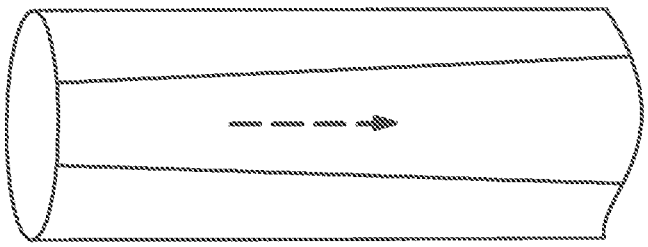
FIG. 3C is a block diagram of another optical fiber having a non-round cross sectional shape, e.g., a D-shape.

FIGS. 3-3C show optical fibers, but only cores of optical fibers. The optical fibers below can also include respective cladding layers (not shown). Arrows in each one of FIGS. 3-3C are indicative of a primary direction of UV light carried by the optical fibers. However, as described below, UV light also escapes the optical fibers in other directions. Techniques described below could be applied to the cladding (not shown) alone, or in conjunction with techniques described below as applied to the core.

Referring now to FIG. 3, an optical fiber can be used as the optical fibers of FIGS. 1 and 2. The optical fiber is filled with light scattering objects. For example, a holey fiber is known and is filled with tiny gas bubbles or voids. The holey fiber passes some light down the holey fiber in a direction of an arrow, yet some light escapes the holey fiber in other directions.

In other embodiments, the light scattering objects can be nanoparticles. The nanoparticles can be comprised of, but are not limited to, silicon nanoparticles. Presence of the nanoparticles, like presence of the holes in the holey fiber, results in some UV light, and preferably a controlled amount of the UV light, escaping the optical fiber.

The optical fiber can be impregnated with many types of light scattering objects, which can include, but which are not limited to, air pockets, plastic particles, metal particles, or glass particles.

As described above in conjunction with FIG. 1, in order to cause approximately the same amount of light to escape the optical fiber down a length of the optical fiber, it may be desirable to provide the optical fiber with a physical characteristic that changes down the length of the optical fiber. In some embodiments, the physical characteristic that changes comprises a number of the light scattering objects per volume within the optical fiber or within selected ones of a plurality of optical fibers. Thus, at a first region along the optical fiber, the optical fiber has a first number of light scattering objects per volume embedded therein, and at a second region along the optical fiber, the optical fiber has a second different number of light scattered objects per volume embedded therein. In some embodiments, the number of light scattering objects per volume can increase down the length of the fiber in a direction away from the ultraviolet light source.

Referring now to FIG. 3A, an optical fiber can be used as the optical fibers of FIGS. 1 and 2. The optical fiber has so-called "microbends" upon the surface of the optical fiber. The optical fiber of FIG. 3A passes some light down the optical fiber in a direction of an arrow, yet some light escapes the optical fiber in other directions.

In some embodiments, the microbends can result when the optical fiber is part of the mesh as shown in FIG. 2 and the mesh is compressed. The compression results in fibers running across the optical fiber of FIG. 3A placing dents or microbends in the optical fiber.

As described above in conjunction with FIG. 1, in order to cause approximately the same amount of light to escape the optical fiber down a length of the optical fiber, it may be desirable to provide the optical fiber with a physical characteristic that changes down the length of the optical fiber. In some embodiments, the physical characteristic that changes comprises a number of the microbends per unit length upon the optical fiber or upon selected ones of a plurality of optical fibers. Thus, at a first region along the optical fiber, the optical fiber has a first number of microbends per length disposed thereon, and at a second region along the optical fiber, the optical fiber has a second different number of microbends per length disposed thereon. In some embodiments, the number of microbends per length can increase down the length of the fiber in a direction away from the ultraviolet light source.

Referring now to FIG. 3B, an optical fiber can be used as the optical fibers of FIGS. 1 and 2. The optical fiber has a surface roughness indicated by a crosshatch upon the surface of the optical fiber. The surface roughness can be generated, for example, by abrasion techniques, or, for another example, by chemical etching techniques. The abrasion or etching is applied to the core of the optical fiber. Similar techniques can be applied to the cladding (not shown).

As described above in conjunction with FIG. 1, in order to cause approximately the same amount of light to escape the optical fiber down a length of the optical fiber, it may be desirable to provide the optical fiber with a physical characteristic that changes down the length of the optical fiber. In some embodiments, the physical characteristic that changes comprises roughness of the surface roughness along a length of the optical fiber or along lengths of selected ones of a plurality of optical fibers. Thus, at a first region along the optical fiber, the optical fiber has a first surface roughness disposed thereon, and at a second region along the optical fiber, the optical fiber has a second different surface roughness disposed thereon. In some embodiments, the surface roughness can increase down the length of the fiber in a direction away from the ultraviolet light source.

Referring now to FIG. 3C, an optical fiber can be used as the optical fibers of FIGS. 1 and 2. The optical fiber has a flattened surface upon one or more surfaces of the optical fiber. The flattened surface can be generated, for example, by abrasion techniques, or, for another example, by chemical etching techniques, or for another example, by extrusion techniques as the optical fiber is formed. The resulting optical fiber can have a cross section with a D shape. However, other shapes are also possible.

As described above in conjunction with FIG. 1, in order to cause approximately the same amount of light to escape the optical fiber down a length of the optical fiber, it may be desirable to provide the optical fiber with a physical characteristic that changes down the length of the optical fiber. In some embodiments, the physical characteristic that changes comprises a cross-sectional shape of the optical fiber along a length of the optical fiber or along lengths of selected ones of a plurality of optical fibers. The cross section is taken parallel to a thickness direction of the optical fiber. Thus, at a first point (cross section) along the optical fiber, the optical fiber has a first cross-sectional shape, and at a second point (cross section) along the optical fiber, the optical fiber has a second different cross-sectional shape. In some embodiments, the flat part of the cross-sectional shape can become greater down the length of the optical fiber in a direction away from the ultraviolet light source.

While it is described above in conjunction with FIGS. 3-3B that other characteristics of the optical fiber can change down the length of the optical fiber, in some embodiments, the number of light scattering particles, the number of microbends, or the surface roughness remains substantially constant down the length of the optical fibers, and the cross-sectional shape changes down the length of the optical fibers to control and to keep consistent and amount of light emitted by the optical fibers. However in still other embodiments the number of light scattering particles, the number of microbends, or the surface roughness of the optical fiber can change down the length of the optical fiber and the cross-sectional shape of the optical fiber can change down the length of the optical fiber as well.

Figure 4:
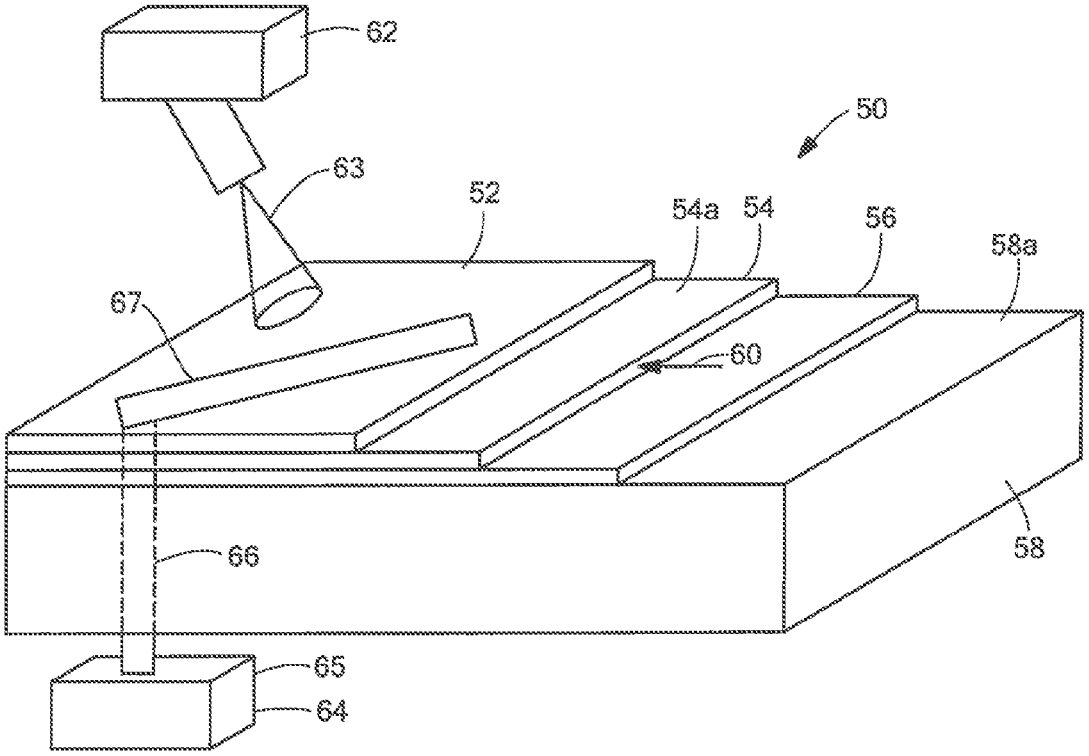
FIG. 4 is a block diagram showing an optical medium comprised of an optical layer disposed over a protected surface, wherein the optical layer is coupled to receive UV light and configured to distribute the UV light, and showing means of cleaning the protected surface, optionally including at least one of a wiper or a water jet.

Referring now to FIG. 4, a system 50 includes a protected surface part (e.g., outer surface) of a layer 52 proximate to plurality of layers, including an optical medium having an optical coating (or layer) 54 bonded proximate to a surface 58*a* of a structure, for example, a ship's hull 58. The optical coating 54 is configured to provide the propagation path of ultraviolet light 60 in one or more directions parallel to a surface 54*a* (and also emitting perpendicular to the surface 54*a*) of the optical coating 54.

The system 50 can also include a reflective coating (or layer) 56 under the optical coating 54 and the coating (or layer) 52 over the optical coating 54, which is transparent or substantially transparent to UV light. UV light, represented by an arrow 60, can propagate in the optical coating 54 in any direction.

In some embodiments, the optical layer 54 is comprised of, but is not limited to, a urethane acrylate, for example, Permacol 387/10 (refractive index of 1.48) or Dymax OP-4-20632 (refractive index of 1.554).

In other embodiments, the optical layer 54 is comprised of, but is not limited to, an amorphous Polytetrafluoroethylene (PTFE or Teflon™), a Hexafluoropropylene and Vinylidene fluoride (THV), a Polyether ether ketone (PEEK), a Fluorinated ethylene propylene (FEP), an Ethylene Tetrafluoroethylene (ETFE), or a Polymethylpentene (PMP).

In some embodiments, the reflective layer 56 is comprised of, but is not limited to, a polished metal film and/or an aluminized/metalized polyester film, e.g., Mylar.

In some embodiments, the system 50 also includes a cleaning mechanism, which can be either a water jet mechanism 62 or a wiper mechanism 64 or both. The water jet mechanism 62 is configured to spray a high pressure water jet 63 upon a surface of the layer 52. The wiper mechanism 64 can include a motor 65, a shaft 66 coupled to the motor 65, and a wiper 67 coupled to the shaft 66. The wiper 67 is configured to brush back and forth upon the layer 52.

A characteristic of the optical coating 54 can be selected to allow, at any region along the surface 54*a* surface of the optical coating 54, a determined percentage of a total power of an ultraviolet light source (not shown) to escape the optical layer. In order to achieve this behavior, the optical coating 54 can have a characteristic that changes about the surface 54*a* of the optical coating 54. For example, the surface 54*a* of the optical coating 54 can have s surface roughness that changes about the surface 54*a*. In other embodiments, the optical coating can be impregnated with light scattering particles, the density of which changes about the optical coating 54.

The above listed changing characteristics can change in a pattern about the surface. For example, the changing characteristics can change radially and continuously from a point at which UV light enters the optical coating 54. In other embodiments, the changing characteristics can change radially and discontinuously (e.g., in rings) from a point at which UV light enters the optical coating 54. In other embodiments, the changing characteristics can change along parallel lines and continuously from a point or from a line at which UV light enters the optical coating 54. In other embodiments, the changing characteristics can change along parallel lines and discontinuously from a point or from a line at which UV light enters the optical coating 54.

In some embodiments, bonds between the various layers 52, 54, 56 and between the layer 56 and the surface 58*a* comprise chemical bonds.

In some embodiments, bonds between the various layers 52, 54, 56 and between the layer 56 and the surface 58*a* comprise adhesive bonds.

In some embodiments, the reflective coating 56 is not used. In these embodiments, the surface 58*a* can be polished. In some embodiments, the coating 52 is not used.

It has been recognized that which has not been previously recognized. It is known that, during a time period when ultraviolet light does not emanate from the optical layer 54, biological organisms (e.g., barnacles) can adhere to the layer 52. However, it has not been previously known that ultraviolet light emanating from the optical layer 54 after the biological organisms have attached to the layer 52 tends to break down the bonding compositions of the biological organisms. Furthermore, it has not been previously known the great extent to which the bonding compositions are broken down. In particular, it has been discovered that, once exposed to the ultraviolet light emanating from the optical layer 54, the biological organisms can be removed from the surface by only a minimal mechanical means, for example, by the water jet 63 or by the wiper 67. Also, it has been discovered that, in some alternate arrangements for which the system 50 moves thought the water, the water jet mechanism 62 and the wiper mechanism 64 need not be provided, and mere movement through the water at sufficient velocity can remove the biological organisms once affixed to the layer 52 and thereafter irradiated by ultraviolet light emanating from the optical layer 54. In some embodiments, the sufficient velocity is greater than about two knots.

With the above arrangement, it will be recognized that the system 50 can remain dormant in the water and biological organisms can grow thereupon for a period of time, after which the ultraviolet light 60 can be turned on and the surface 52 can be cleaned of the biological organisms, for example, by way of the water jet mechanism 62, by way of the wiper mechanism 64, or by way of movement of the system 50 through the water.

Particularly for some military systems, a temporary growth of biological organisms upon the layer 52 can result in a desirable camouflage affect, until such time that the system 50 is activated, whereon the ultraviolet light can be turned on and the biological organisms can be cleaned from the layer 52.

An optical medium (a transmission medium), here the optical layer 54, can be disposed proximate to the protected surface of layer 52 and coupled to receive the ultraviolet light. The optical layer 54 has a thickness direction perpendicular to the protected surface of layer 52. Two orthogonal directions of the optical layer 54 orthogonal to the thickness direction are parallel to the protected surface of layer 52. The optical layer 54 is configured to provide a propagation path of the ultraviolet light such that the ultraviolet light travels within the optical layer 54 in at least one of the two orthogonal directions orthogonal to the thickness direction, and such that, at points along a surface of the optical medium 54, respective portions of the ultraviolet light escape the optical medium.

Figure 4A:
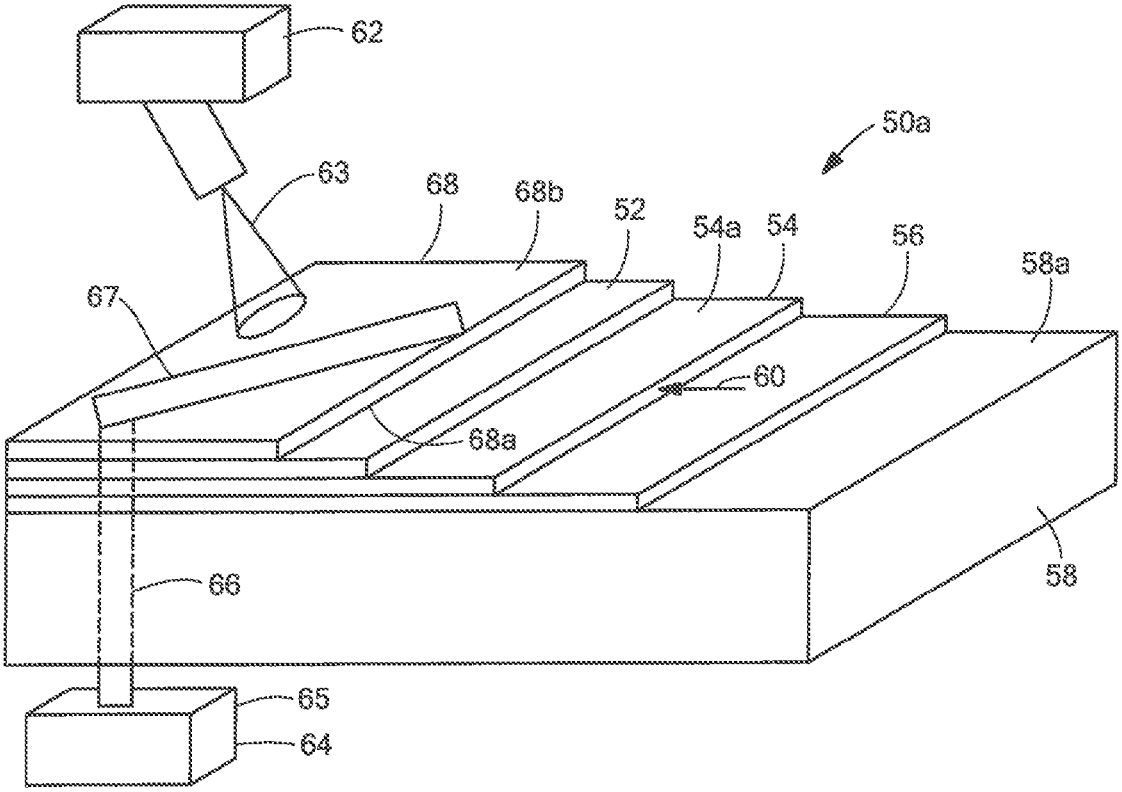
FIG. 4A is a block diagram showing an optical medium comprised of an optical layer disposed over a protected surface, and a degradable layer disposed over the optical layer, wherein the optical layer is coupled to receive UV light and configured to distribute the UV light about the degradable layer, and showing means of cleaning the protected surface, optionally including at least one of a wiper or a water jet.

Referring now to FIG. 4A, in which like elements of FIG. 4 are shown having like reference designations, a system 50*a* is similar to the system 50 of FIG. 4, however, the system 50*a* has an additional layer 74 having inner and outer surfaces 68*a*, 68*b*, respectively.

The layer 68 referred to herein as a "degradable" layer. The degradable layer 68 is configured to change mechanical properties in response to the ultraviolet light 60 emanating from the optical layer 54. In some embodiments, the inner surface 68*a* changes mechanical properties, in some other embodiments, the outer surface 68*b* changes mechanical properties, in some other embodiments, both the inner surface 68*a* and the outer surface 68*b* change mechanical properties, and in some other embodiments, the degradable layer 68 changes mechanical properties throughout a thickness of the degradable layer 68.

The degradable layer 68 changes mechanical properties such that, before being exposed to the ultraviolet light 60, the degradable layer 68 is structurally sound and has physical integrity, and after being exposed to the ultraviolet light 60, the degradable layer 68 and/or surfaces 68*a*, 68*b* thereof, lose mechanical integrity, and thus, the degradable layer 68 and/or surfaces 68*a*, 68*b* thereof are more easily removed by action of the water jet mechanism 62, the wiper mechanism 64, or by movement through the water.

For embodiments in which integrity of the inner surface 68*a* degrades in response to the Ultraviolet light, the entire degradable layer 68 can be removed, and the system 50*a* can provide a one-time removal of the degradable layer 68 and biological organisms attached thereto. For these arrangements, the inner surface 68*a* can be comprised of an ultraviolet responsive adhesive that tends to bond the degradable layer 68 to the layer 52. Exemplary compounds that ran be used at the inner surface 68*a* include, but are not limited to, polyesters and hot melt adhesives (e.g., styrene-isoprene-styrene or SIS).

For embodiments in which integrity of the entire degradable layer 68 degrades in response to the ultraviolet light, the entire degradable layer 68 can be removed, and the system 50*a* can provide a one-time removal of the degradable layer 68 and biological organisms attached thereto. Exemplary compounds that can be used for the degradable layer 68 of this type include, but are not limited to chitosan film, polycarbonate film, and polymethylmethacrylate film.

For still other embodiments in WHICH integrity of the entire degradable layer 68 degrades in response to the ultraviolet light, a UV degradable paint can be used. An exemplary degradable layer of this type is described in U.S. Published Patent Application No. 2007/0287766, entitled "Easily Removable UV Degradable Paint and Process for Applying the Same," and published Dec. 13, 2007, which is incorporated herein in its entirety. The published patent application describes a UV reactive paint having a binder with acid-degradable groups and also a photoacid generator that provides photogenerated acid upon exposure to ultraviolet light.

In some embodiments, the binder of the UV reactive paint comprises a reaction product of a first polymer with carbolic acid groups formed from thermal degradation of corresponding ammonium salts of the carbolic acid, and a second polymer having pendant vinyl ether groups.

In some embodiments, the binder of the UV reactive paint comprises a thermal degradation product of a polymer having thermally degradable groups comprising ammonium salts of carbolic acid groups and also having acid degradable groups comprising acid degradable derivatives of carbolic acid groups.

Figure 4B:
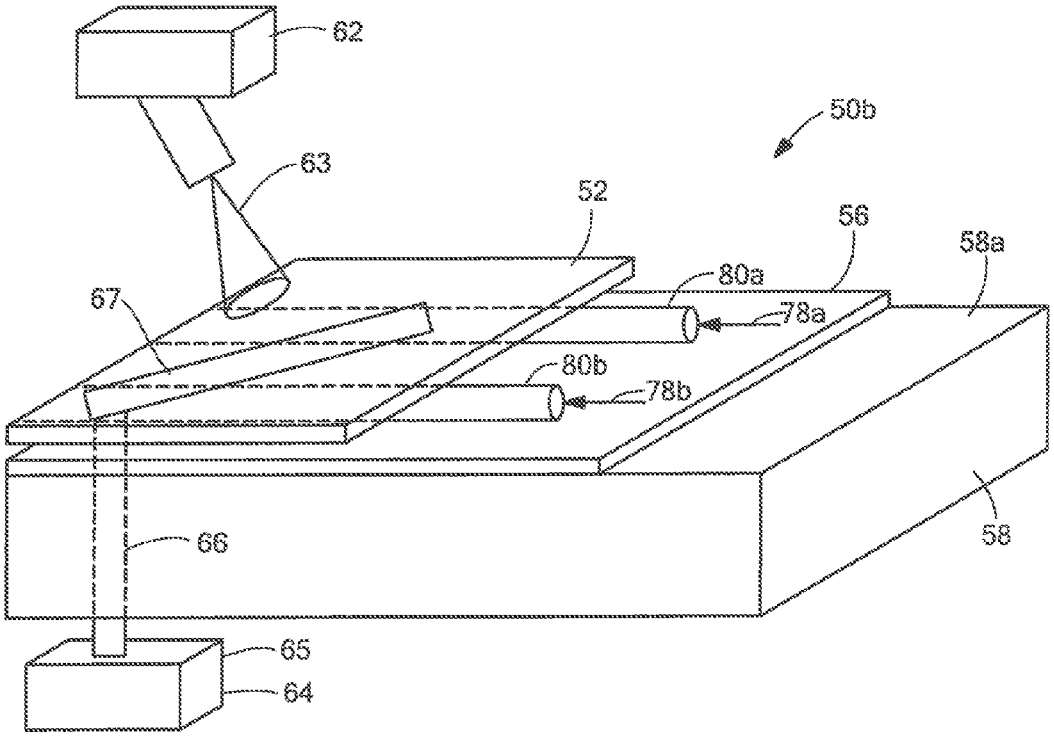
FIG. 4B is a block diagram showing an optical medium comprised of one or more optical fibers disposed over a protected surface, wherein the one or more optical fibers are coupled to receive UV light and configured to distribute the UV light, and showing means of cleaning the protected surface, optionally including at least one of a wiper or a water jet.

Referring now to FIG. 4B, in which like elements of FIGS. 4 and 4A are shown having like reference designations, a system 50*b* is similar to the system 50 of FIG. 4, however, the optical layer 54 of FIG. 4 is replaced by another optical medium in the form of optical fibers 80*a*, 80*b*, which are representative of the systems 10, 30 of FIG. 1. As described above in conjunction with FIGS. 1-3C, the optical fibers 80*a*, 80*b* distribute (i.e., leak) ultraviolet light along lengths of the optical fibers.

Operation of the system 50*b* is substantially the same as operation of the system 50 of FIG. 4.

Figure 4C:
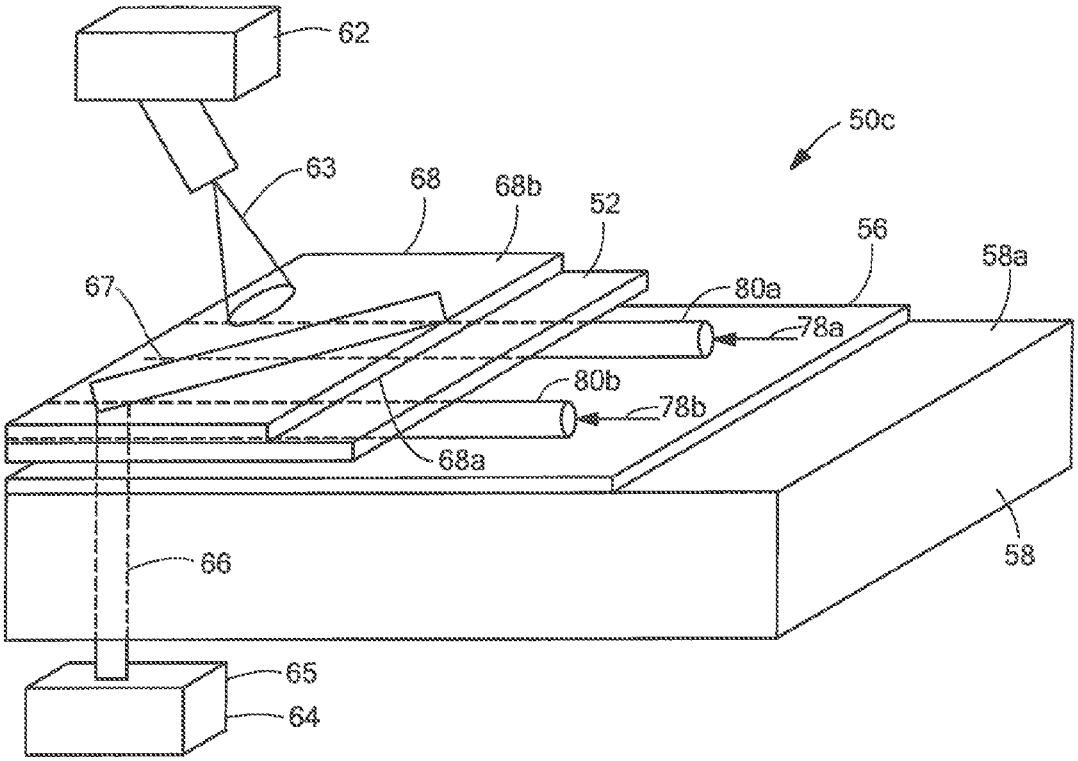
FIG. 4C is a block diagram showing an optical medium comprised of one or more optical fibers disposed over a protected surface and a degradable layer disposed over the one or more optical fibers, wherein the one or more optical fibers are coupled to receive UV light and configured to distribute the UV light about the degradable layer, and showing means of cleaning the protected surface, optionally including at least one of a wiper or a water jet.

Referring now to FIG. 4C, in which like elements of FIGS. 4, 4A, 4B are shown having like reference designations, a system 50*c* is similar to the system 50*a* of FIG. 4A, however, the optical layer 54 of FIG. 4A is replaced by another optical medium in the form of the optical fibers 80*a*, 80*b*.

Operation of the system 50*c* is substantially the same as operation of the system 50*a* of FIG. 4A.

Figure 4D:
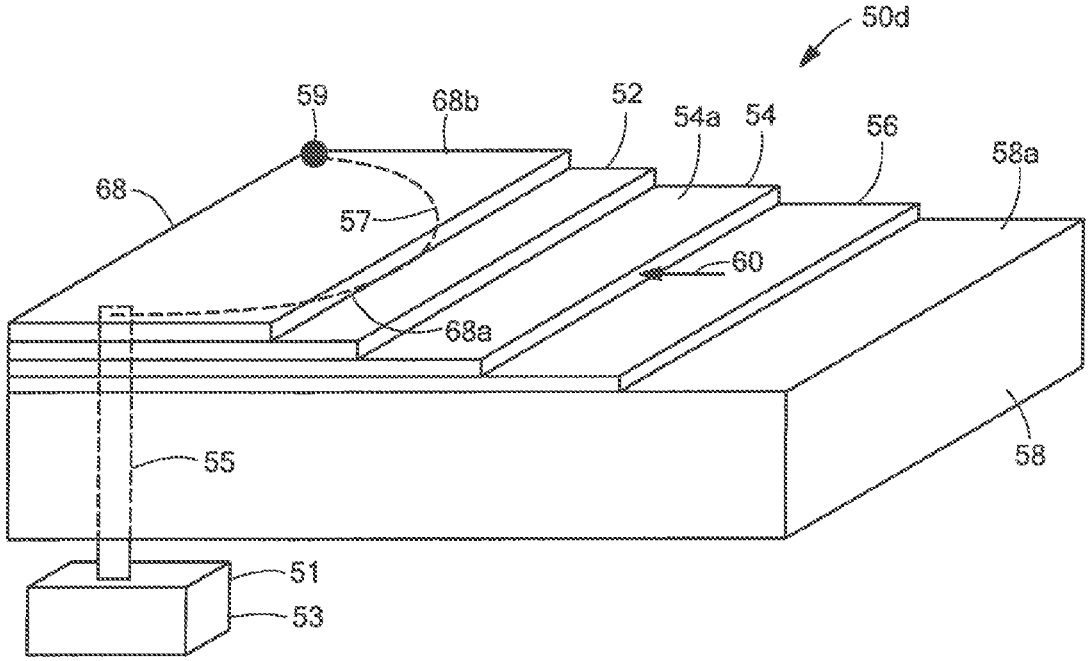
FIG. 4D is a block diagram showing an optical medium comprised of an optical layer disposed over a protected surface, and a degradable layer disposed over the optical layer, wherein the optical layer is coupled to receive UV light and configured to distribute the UV light about the degradable layer, and showing means of cleaning the protected surface, optionally including a motor and a pull wire.

Referring now to FIG. 4D, in which like elements of FIGS. 4, 4A, 4B, and 4C are shown having like reference designations, a system 50*d* is similar to the system 50*a* of FIG. 4A, however, the wiper mechanism 64 and the water jet mechanism 62 are replaced by a pull wire mechanism 51 configured to remove the degradable layer 68 after the degradable layer 68 is mechanically degraded by exposure to the ultraviolet light 60.

The pull wire mechanism 51 can include a motor 53 coupled to a shaft 55 operable to rotate when the motor 53 is enabled. A pull wire 57 can be disposed under the degradable layer 68 and over the layer 52. A far end of the pull wire 57 can be coupled to the system 50*d* with a tether point 59, which can include a shear pin configured to break upon application of a predetermined tension force by the pull wire 57.

It will be apparent that, once the degradable layer 68 is exposed to the ultraviolet light 60, becoming mechanically degraded, and, as the shaft 55 rotates thereafter, the shaft 55 pulls the pull wire 57, resulting in the mechanically degraded degradable layer 68 being peeled away from the layer 52. In some embodiments, the shaft 55 can continue to rotate, causing the shear pin 59 to break and the pull wire 57 to be entirely wrapped around the shaft 55.

In some embodiments, rather than the degradable layer 68 begin peeled away from the layer 52, the degradable layer merely crushes laterally or accordions to clear away from the layer 52.

Figure 4E:
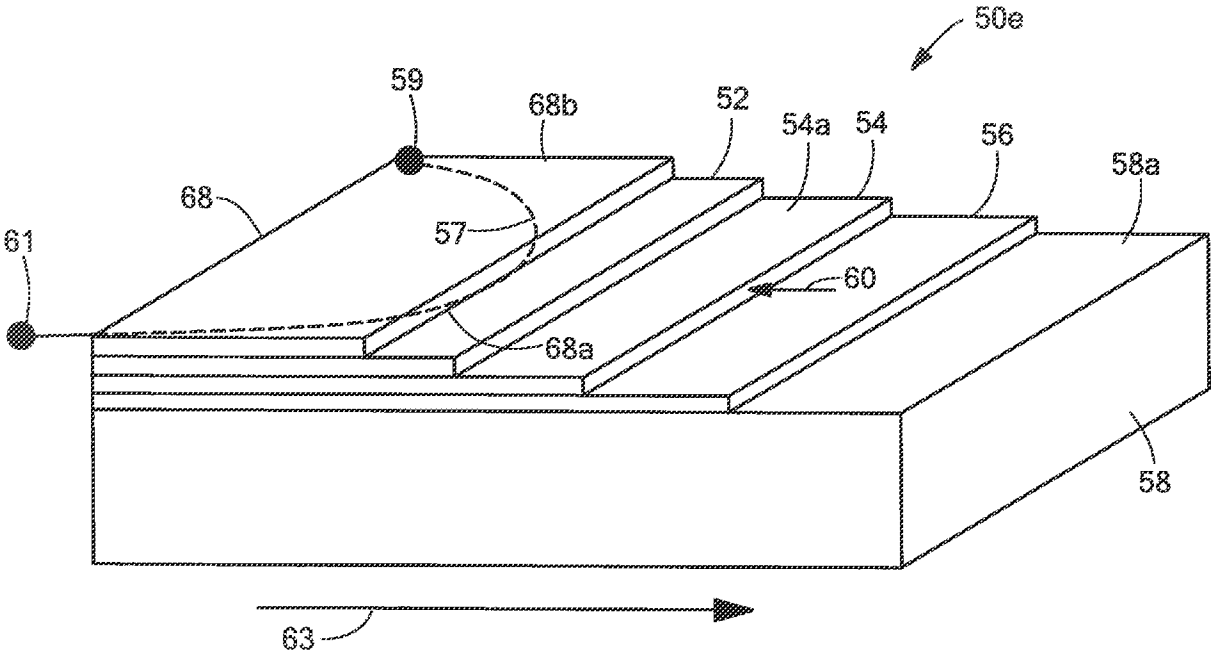
FIG. 4E is a block diagram showing an optical medium comprised of an optical layer disposed over a protected surface, and a degradable layer disposed over the optical layer, wherein the optical layer is coupled to receive UV light and configured to distribute the UV light about the degradable layer, and showing means of cleaning the protected surface, optionally including a tethered pull wire.

Referring now to FIG. 4E, in which like elements of FIGS. 4, 4A, 4B, 4C, and 4D are shown having like reference designations, a system 50*e* is similar to the system 50*d* of FIG. 4D, however, the motor 53 and the shaft 55 are not used. Instead, the pull wire 57 is tethered to a fixed tether point 61, which can be apart from a moveable body, for example, an AUV, upon which the system 50*e* is disposed.

It will be apparent that, once the degradable layer 68 is exposed to the ultraviolet light 60, becoming mechanically degraded, and, as the body represented by the system 50*e* moves in a direction of an arrow 63, the fixed tether point 61 results in tension on the pull wire 57, resulting in the mechanically degraded degradable layer 68 being peeled away from the layer 52.

In some embodiments, rather than the degradable layer begin peeled away from the layer 52, the degradable layer merely crushes laterally or accordions to clear away from the layer 52.

While FIGS. 4D and 4E show arrangements having the optical layer 54 used to disburse the ultraviolet light 60, in other embodiments, the optical layer 54 can be replaced by optical fibers, such as the optical fibers 80*a*, 80*b* of FIGS. 4B and 4C.

Figure 5:
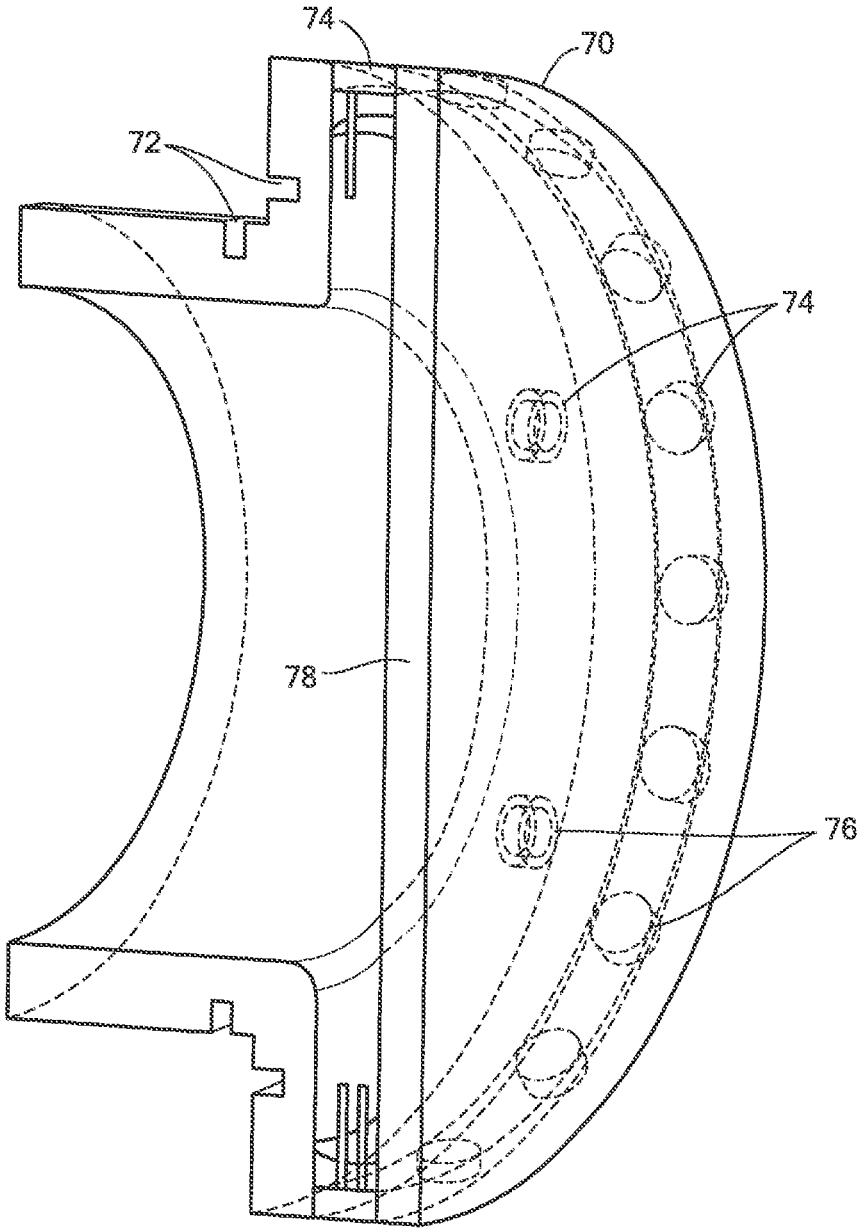
FIG. 5 is a block diagram showing an exemplary penetrating structure configured to penetrate through a protected surface, for example, the protected surfaces of FIG. 1 or 4-4C, wherein the penetrating structure includes an optical structure configured to generate UV light and configured to inject the UV light into an optical medium.

Referring now to FIG. 5, an exemplary penetrating structure 70 is configured to penetrate through a protected surface, for example, the surface 58*a* of FIG. 4 or the protected surface 26 of FIG. 1. The penetrating structure 70 comprises a seal region 72 coupled between the penetrating structure and the protected surface. In some embodiments the seal region 72 includes a seal, for example, an O-ring seal (not shown). An optical structure 74 is configured to generate the ultraviolet light and configured to inject the ultraviolet light into an optical medium, for example, into the optical fibers 12*a*, 12*b*, of FIG. 1, the optical fibers of FIG. 2, the optical fibers of FIGS. 3-3C, or the optical layer 54 of FIGS. 4 and 4A. The optical structure 76 and include a plurality of ultraviolet light sources 76, for example UV light emitting diodes. The penetrating structure can include a cover 78 that can be a part of a protected surface.

In some embodiments, the penetrating structure 70 is configured to generate the ultraviolet light in a direction outward from the penetrating structure 70 and into, for example, a surrounding optical layer like the optical layer 54 of FIGS. 4 and 4A.

However, in other embodiments, the penetrating structure 70 is configured to generate at least some of the ultraviolet light in a direction inward into the penetrating structure 70. This arrangement is particularly suitable for arrangements in which the cover 78 is the protected surface and is also a transparent optics window that covers the penetrating structure. An optics window can be used, for example, to act as a window through which an underwater camera can operate. It may be desired to clear biological organisms from the optics window. Optics windows are described more fully below in conjunction with FIG. 10.

Where the cover 78 is an optics window, while much of the optical structure 74 and UV light emitting diodes 76 thereof are shown to be in a plane below the cover, in other embodiments, the optical structure 74 can be in the same plane as the cover and can direct ultraviolet light into the cover 78.

Any of the systems 50, 50*a*, 50*b*, 50*c* of FIGS. 4, 4A, 4B, 4C, respectively can be disposed proximate to the cover 78, including the above-identified layers and cleaning mechanism. However, for embodiments, in which the cover 78 is an optics window, the reflective layer 56 would not be used. Also, for embodiments, in which the cover 78 is an optics window, unless the entire degradable layer 68 is removed by operation of the systems 50*a*, 50*c*, the degradable layer 68 should be transparent.

Figure 6:
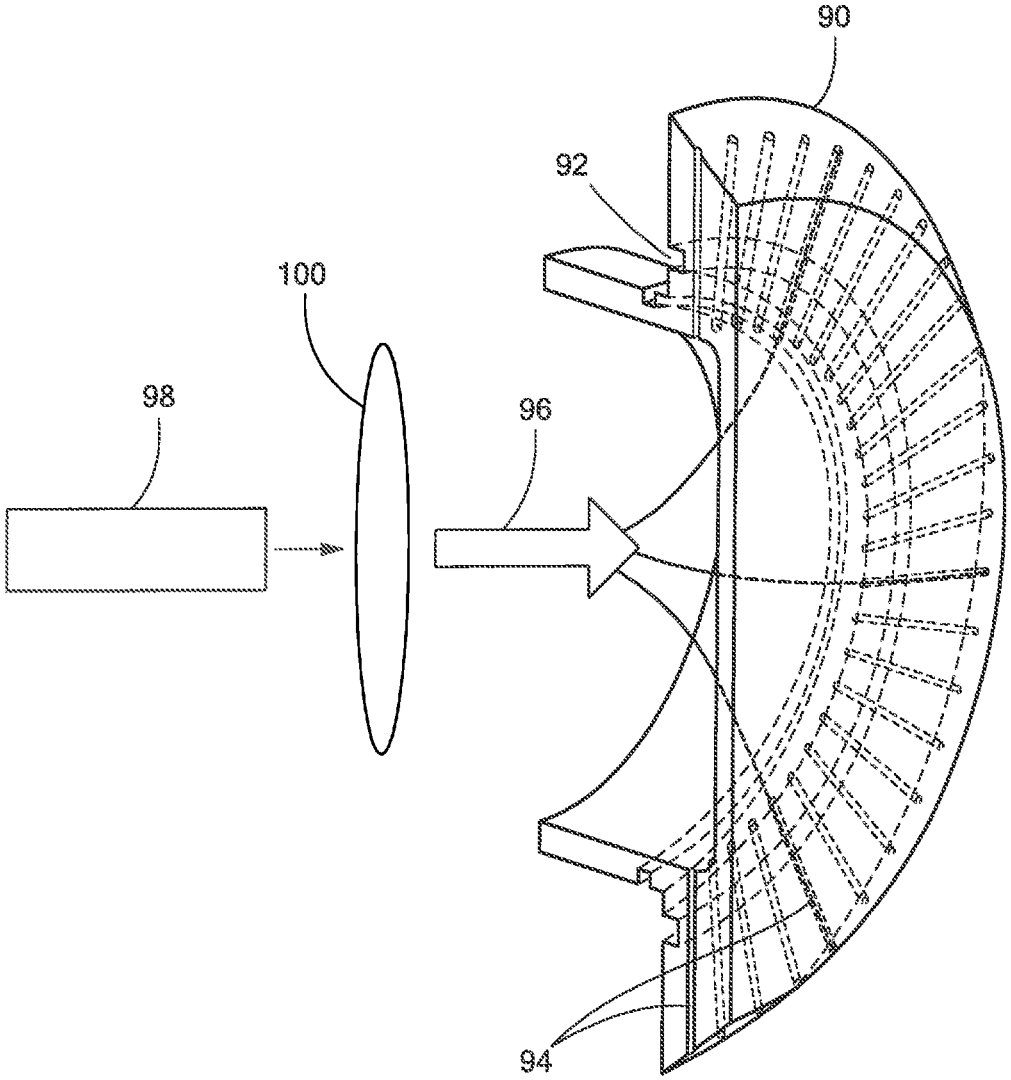
FIG. 6 is a block diagram showing another exemplary penetrating structure configured to penetrate through a protected surface, for example, the protected surfaces of FIG. 1 or 4-4C, wherein the penetrating structure includes an optical structure configured to receive UV light and configured to inject the UV light into an optical medium.

Referring now to FIG. 6, another exemplary penetrating structure 90 is configured to penetrate through a protected surface, for example, the surface 58*a* of FIG. 4 or the protected surface 26 of FIG. 1. The penetrating structure 90 comprises a seal region 92 coupled between the penetrating structure and the protected surface. In some embodiments the seal region 92 includes a seal, for example, an O-ring seal (not shown).

An optical structure 94 is coupled to receive UV light from a UV light source 98, for example, through a coupling structure 100, and configured to inject the UV light 96 into an optical medium, for example, into the optical fibers 12*a*, 12*b*, of FIG. 1, into the optical fibers of FIG. 2, into the optical fibers of FIGS. 3-3C, or into the optical layer 54 of FIGS. 4 and 4A.

Figure 7:
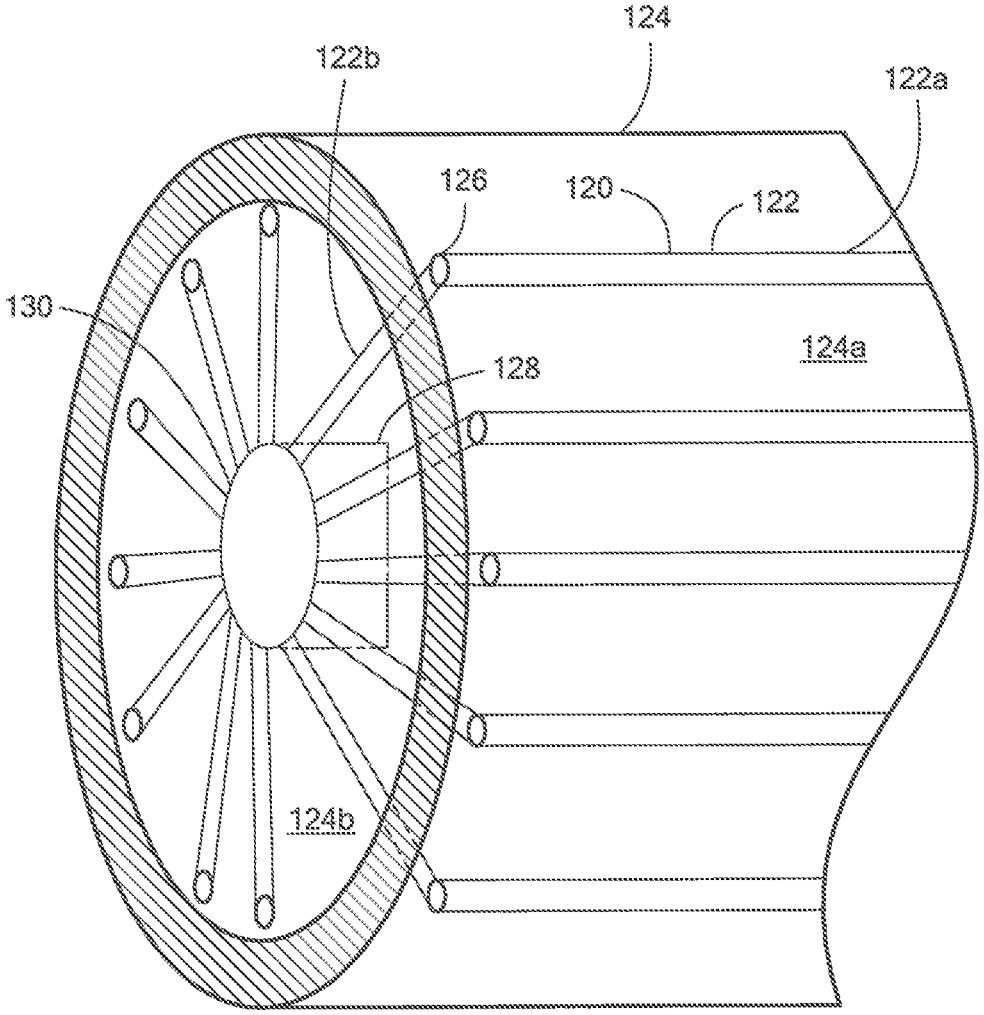
FIG. 7 is a block diagram showing a protected surface as a cylindrical surface, which has an optical medium in the form of optical fibers disposed under the protected surface or embedded in the protected surface.

Referring now to FIG. 7, an optical medium 120 can be comprised of a plurality of optical fibers, of which an optical fiber 122 is but one example. The optical fibers can have portions, for example a portion 122*a*, disposed upon a protected surface 124*a* of an object 124. Each optical fiber can have a pass through, for example, a pass through 126, passing through the object 124 from outside of the object to an inside 124*b* of the object 124.

Each optical fiber, for example, the optical fiber 122, can have a pass-through portion, for example, the pass-through portion 122*b* terminating in an optical coupler 130. A UV light source 128 can be coupled to provide UV light to the optical coupler 130, which is distributed to each one of the optical fibers.

The optical fibers 122 can be the same as or similar to any of the optical fiber shown above in conjunction with FIGS. 3-3C, or part of the mesh of FIG. 2. The optical fibers 122 can be disposed upon the surface 124*a*. In other embodiments, the optical fibers can be disposed within or under the surface 124*a*. For those embodiments in which the optical fibers are disposed within or under the surface 124*a*, the object 124 is transparent or nearly transparent to UV light.

Spacings between the optical fibers and power carried by the optical fibers are selected according to criteria described above in conjunction with FIG. 1.

In some embodiments, the object 124 is comprised of composite graphite. In other embodiments the object 124 is comprised of plastic.

The object 124 can be a pressure vessel configured to be disposed in water. For these embodiments, sealed end caps (not shown) can be disposed over ends of the object 124. In some embodiments, the object 124 is part of an autonomous underwater vehicle (AUV), or alternatively, an unmanned underwater vehicle (UUV). In other embodiments, the object 124 is part of a towed body.

It should be understood that the outer surface 124*a* of the object 124 can include any of the layers and mechanisms described above in conjunction with FIGS. 1-4C.

Figure 8:
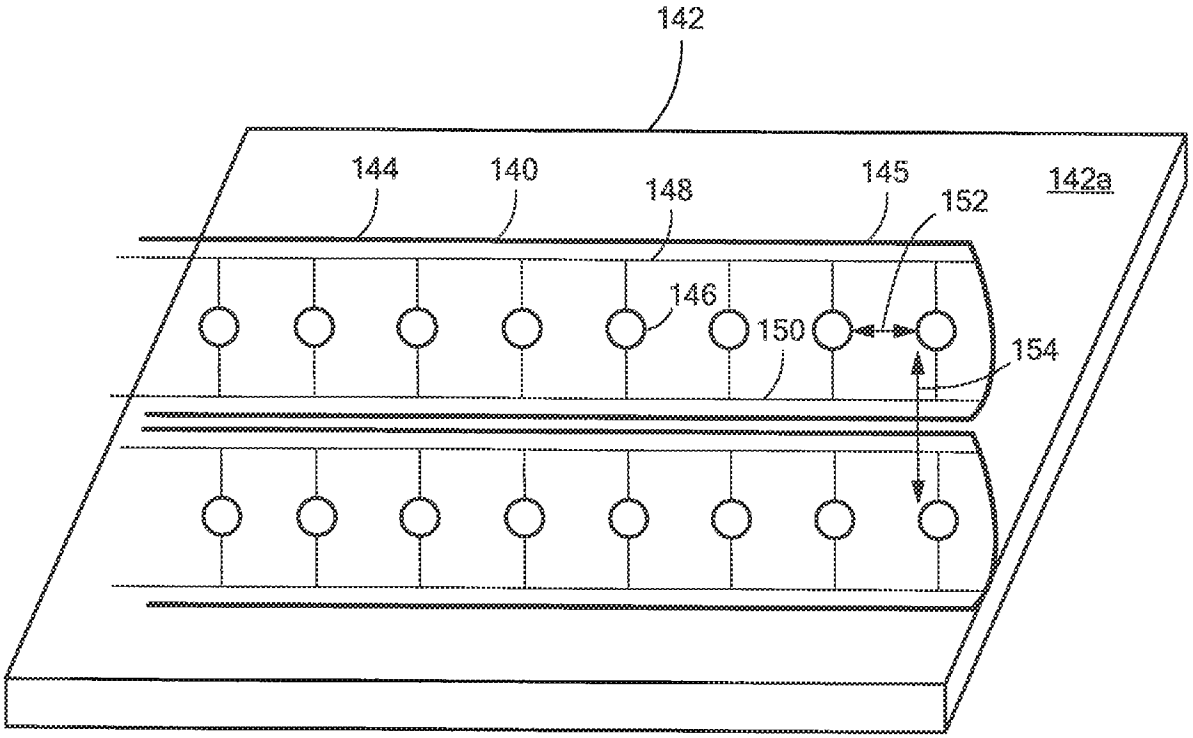
FIG. 8 is a block diagram showing two strip structures that can provide an optical medium upon a protected surface, the two strip structures each having a plurality of UV LEDS.

Referring now to FIG. 8, an optical medium 140 is comprised of one or more strips structures, for example, a strip structure 144. An ultraviolet light source comprises a plurality of UV LEDS, of which a UV LED 146 is but one example. The plurality of UV LEDs (UV light sources) and the optical medium are conjoined in a composite structure. The composite structure comprises one or more strip structures. Each strip structure includes a strip backing medium 145 and a plurality of UV LEDS coupled to the strip backing medium 145. The strip backing medium 145 is coupled proximate to a protected surface 142*a*.

The plurality of UV LEDS have spacings 152, 154 between the UV LEDS, UV output powers, and beamwidths of the UV light selected to result in an effect upon growth of biological growth upon a substantial portion of the protected surface 142*a*.

Spacings between the UV LEDS, beamwidths, and powers of the UV LEDS are selected according to criteria described above in conjunction with FIG. 1.

While two strips structures are shown, in other embodiments, there can be more than or fewer than two strip structures.

It should be understood that the outer surface 142*a* can include any of the layers and mechanisms described above in conjunction with FIGS. 1-4C.

Figure 9:
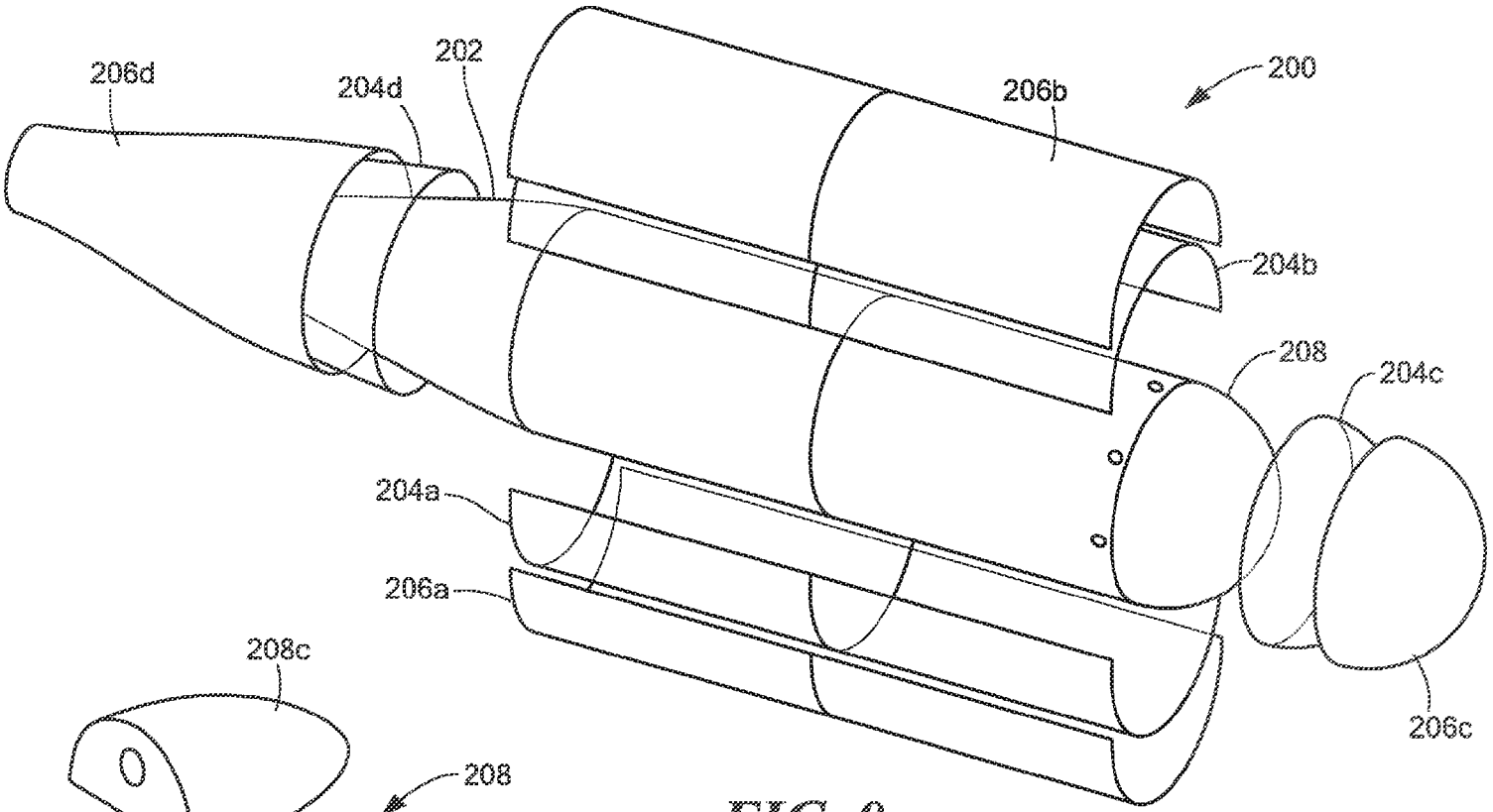
FIG. 9 is an exploded view block diagram of an autonomous underwater vehicle (AUV), for which an outer surface is a protected surface, wherein an optical medium is disposed over the protected surface and a degradable layer is disposed over the optical medium, wherein the optical medium is coupled to receive UV light and configured to distribute the UV light about the degradable layer, and showing means of cleaning the protected surface, optionally including a water jet mechanism having water jet nozzles.

Referring now to FIG. 9, a structure 200 can be, for example, an autonomous underwater vehicle (AUV). The AUV 20 can include a body 202, and an optical medium 204, shown here in four portions 204*a*, 204*b*, 204*c*, 204*d* over which a degradable layer 206, shown herein in four portions 206*a*, 206*b*, 206*c*, 206*d*, is disposed. Other layers can also be provided as are shown, for example, in FIGS. 4-4C. The optical medium 204*a*, 204*b*, 204*c*, 204*d* can include a continuous optical layer such as the optical layer 54 described above in conjunction with FIGS. 4 and 4A. However, in other embodiments, the optical medium 204*a*, 204*b*, 204*c*, 204*d* can include optical fibers such as the optical fibers 801, 80*b* described above in conjunction with FIGS. 1, 4B, 4C, and 7. In still other embodiments, the optical medium 204*a*, 204*b*, 204*c*, 204*d* can be of a type described above in conjunction with FIG. 8.

A plurality of water jet mechanisms, of which a water jet nozzle 208 is representative, can be disposed proximate to the degradable layer 206*a*, 206*b*, 206*c*, 206*d*. A water pump can be within the AUV 200 and can be coupled to the water jet nozzles, but is not shown.

In operation, once biological organisms have affixed to the AUV 200, an ultraviolet light source within the AUV 202 can direct ultraviolet light into the optical medium 204*a*, 204*b*, 204*c*, 204*d*. The ultraviolet light can be directed into the optical medium 204*a*, 204*b*, 204*c*, 204*d* in a variety of ways, for example, by penetrating structures such as those described above in conjunction with FIGS. 5 and 6.

Ultraviolet light emanating from the optical medium 204*a*, 204*b*, 204*c*, 204*d* can degrade the structural integrity of the degradable layer 206*a*, 206*b*, 206*c*, 206*d*. Once degraded, removal of a least a portion of the degradable layer 206*a*, 206*b*, 206*c*, 206*d* and associated biological organisms can be assisted by the water jet mechanisms. The biological organisms can ultimately be removed by movement of the AUV 200 through the water. In some embodiments, there are no water jets and the degradable layer 206*a*, 206*b*, 206*c*, 206*d* can be removed by the UV light in combination with movement of the AUV through the water alone.

In other embodiments, in accordance with FIGS. 4 and 4B, which have no degradable layer, the biological organisms can be removed by the water jets 280 alone and/or by movement, without a degradable layer.

In accordance with the above, the term "cleaning mechanism" is used herein to describe a mechanism to assist removal of biological organisms from a protected surface after the protected surface has been irradiated with ultraviolet light. Exemplary cleaning mechanisms include, but are not limited to, a wiper mechanism, a water jet mechanism, a pull string mechanism, and a propulsion mechanism that propels a body having the protected surface through the water.

Figure 9A:
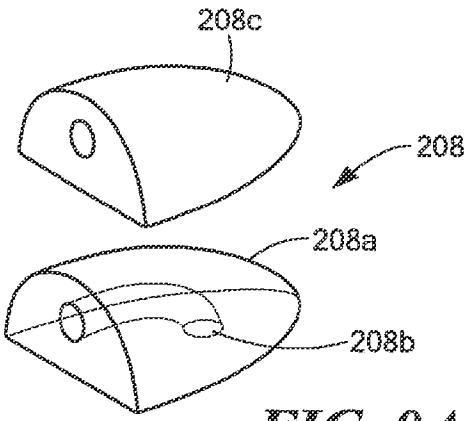
FIG. 9A is an exploded block diagram showing further details of a water jet nozzle of FIG. 9.

Referring now to FIG. 9A, the water jet nozzle 208 of FIG. 9 is shown in greater detail. The water jet nozzle 208 can include a housing 208*a* with a channel 208*b* therein that directs water in one direction, or in a plurality of directions. Layers 208*c* can cover the water jet mechanism. The layers 208*c* can be comprised of any of the layers described above, for example, any of the layers described above in conjunction with FIGS. 4-4C.

Figure 10:
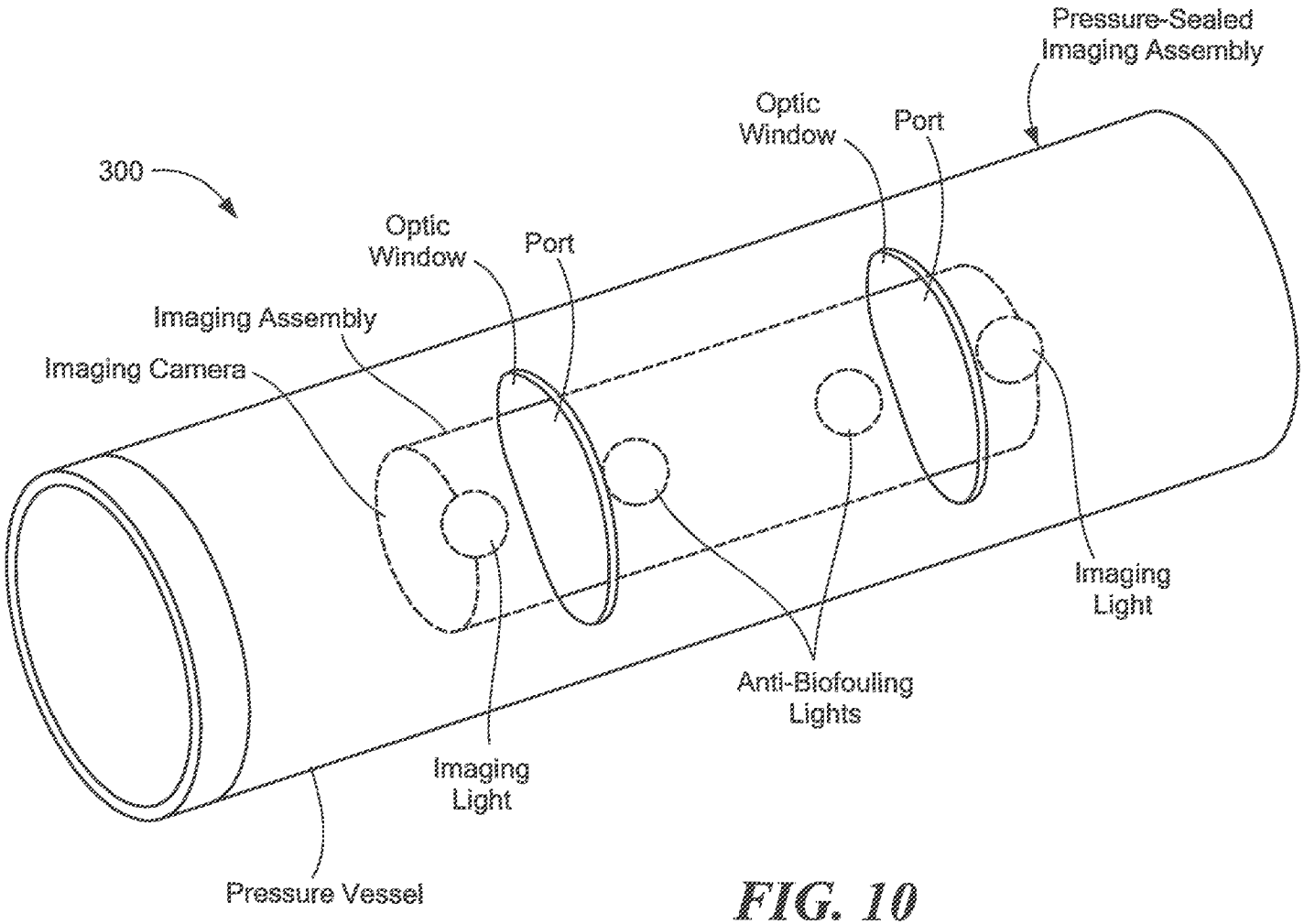
FIG. 10 is a block diagram of an underwater mechanism, for example, an underwater camera having optics windows, UV lights disposed inside the underwater mechanism so as to project UV light toward the optics windows, for which the optics windows are protected surfaces, wherein a degradable layer is disposed over the optics window, wherein the optical layer is coupled to receive UV light and configured to distribute the UV light about the degradable layer, and showing means of cleaning the protected surface, optionally including at least one of a wiper or a water jet.

Referring now to FIG. 10, a pressure-sealed imaging assembly 300 can include a pressure vessel having structural characteristics and material characteristics selected to allow the pressure vessel to survive a liquid environment having pressure (e.g., depth) and liquid chemical properties (e.g., salt). In some arrangements, the pressure vessel is configured to survive in the ocean, a corrosive and high-pressure environment, for substantial periods of time, for example, months or years. In some arrangements, the pressure vessel is designed to survive depths of at least one of five hundred feet, one thousand feet, five thousand feet, ten thousand feet, twenty thousand feet, or thirty thousand feet. In some arrangements, the pressure vessel is designed to survive full ocean depths into the ocean trenches and beyond.

While ocean environments are described in examples herein, it should be understood that the same assemblies and techniques pertain to any liquid environment.

The pressure vessel can include one or more ports that provide respective openings through the pressure vessel. The one or more ports are filled (i.e., sealed) by a respective one or more optics windows, which are windows transparent to imaging light. In high-pressure environments, the optics windows are made from high strength materials.

The optics windows can be made from a variety of materials, including, but not limited to, glass, quartz ($SiO_2$), including crystal or commercial grades of quartz, fused silica ($SiO_2$), including UV or IR grades of fused silica, calcium fluoride ($CaF_2$), magnesium fluoride ($MgF_2$), or sapphire ($Al_2O_3$).

Each of the materials above allows transmission of light having wavelengths suitable for optical imaging in the visible part of the light spectrum (a wavelength range from about 380 or 400 nm to about 760 or 780 nm). In addition, each of the materials listed above allows transmission of light having wavelengths in the ultraviolet part of the light spectrum, in particular, light having a wavelength of about 250-260 nm in the UVC range of the ultraviolet part of the light spectrum. As described above, UVC light can provide ultraviolet germicidal irradiation (UVGI).

The pressure-sealed imaging assembly can include an imaging assembly disposed within an inner volume of the pressure vessel. The imaging assembly can include and imaging camera. The imaging camera can be, but is not limited to, a film still camera, a film movie camera, a digital still camera, a digital video camera, or a laser line scan system (LLSS).

The imaging assembly can also include one or more imaging lights disposed within the inner volume of the pressure vessel and proximate to the optics windows so as to provide light that shines outside of the pressure vessel and that can reflect from objects outside of the pressure vessel to contribute to an optical image captured by the imaging assembly. In some embodiments, the imaging assembly includes no imaging lights and the optical image is generated instead by way of ambient light in the environment, for example, sunlight that penetrates into the ocean.

It will be understood that sunlight does not propagate very far in seawater. It will also be understood that different colors in sunlight tend to propagate different distances in seawater. For example, most of the red and yellow portions of sunlight tend to propagate less than about twenty feet in seawater, leaving blues at greater depths or distances. Thus, in many applications, it is advantageous to have the imaging lights.

The imaging assembly can also include one or more anti-biofouling lights disposed within the inner volume of the pressure vessel and proximate to the optics windows. In operation, the anti-biofouling lights generate continuously or from time to time ultraviolet light having an intensity and a wavelength selected to kill or to repel liquid borne (e.g., marine) organisms that would tend to accumulate and live upon the optics windows. In some embodiments, the anti-biofouling lights generate UVC light. However, in other embodiments, the anti-biofouling lights can generate light having wavelengths in the UVA of UVB parts of the ultraviolet spectrum.

It will be understood that the material of the optics windows must be selected to transmit both imaging light (e.g., visible light) and also the light generated by the anti-biofouling lights (e.g., ultraviolet light).

UVC light is known to be strongly absorbed by air. Thus, if the pressure vessel were filled with air, there may be substantial transmission loss of ultraviolet light generated by the anti-biofouling lights as it propagates from the anti-biofouling lights to the optics windows. However, the pressure vessel can be filled with a gas other than air, for example, nitrogen, which provides excellent transmission of the UVC light from the anti-biofouling lights to the optics windows.

UVC radiation for ultraviolet germicidal irradiation (UVGI) is conventionally generated using mercury vapor lamps. Mercury vapor lamps have size and power requirements undesirable for use within the pressure vessel used underwater for long periods of time. However, in some embodiments the anti-biofouling lights are mercury vapor lamps. In other embodiments, the anti-biofouling lights are comprised of one or more UV lasers, for example, excimer lasers.

Light emitting diodes (LEDs) that can transmit ultraviolet light in the UVA, UVB, and UVC parts of the ultraviolet spectrum are recently available. In particular, UV LEDs (e.g., AlInGaN LEDs) are recently available with appropriate sizes and that can transmit UVC with sufficient intensities and efficiencies to provide the anti-biofouling lights inside of the pressure vessel used underwater for long periods of time. Thus, in some embodiments, the anti-biofouling lights are each comprised of one or more UV LEDs.

In some embodiments, the anti-biofouling lights transmit UVC light having an intensity of about twenty μW per square centimeter at the outer surface of the optics windows. However, the intensity can be more than or less than twenty μW per square centimeter, for example, within a range of about ten to about thirty μW per square centimeter. The intensity of the UVC light can be selected in accordance with a variety of factors, for example, a temperature of the water, a type of the water (e.g., fresh or salt water), or a type of organism (e.g., barnacles) for which anti-biofouling is desired (e.g., barnacles).

In some embodiments, the anti-biofouling lights transmit UVC light having a wavelength of about 254 nm with a total power of about 1200 μW, for an optics window having an outer surface area of about 9.3 square inches (60 square centimeter), resulting in the above-described nominal value of twenty μW per square centimeter. In order to accomplish this intensity from each of the anti-biofouling lights, each one of the anti-biofouling lights may be comprised of a plurality of UV LEDs, for example eight UV LEDs, each transmitting UVC light having a wavelength of about 254 nm with a power of about 150 to 300 μW. However, more than or fewer than eight UV LEDs can be used, with powers adjusted accordingly, in order to achieve the above described intensity of about ten to about thirty μW per square centimeter. In some alternate embodiments, the anti-biofouling lights have a wavelength in the range of about two hundred forty to about two hundred sixty nanometers.

The UV LEDs are known to have optical beam widths ranging from about zero to about one hundred twenty degrees. Therefore, a number and a spacing of UV LEDs is selected to form each one of the anti-biofouling lights to provide a fairly uniform intensity of ultraviolet light over an outer surface of the optics windows, where organisms might otherwise tend to attach.

In some embodiments, since they are small, the UV LEDs can be retrofitted into an existing pressure-sealed imaging assembly.

In some embodiments, over the optics windows are disposed layers such as the layer described above in conjunction with FIGS. 4-4C, but without the optical layer 54 or the optical fibers 80*a*, 80*b*, which are replaced by the anti-biofouling lights, which project UVC light through the optics windows. Thus, like assemblies described above, biological organisms can affix to the optics windows of the pressure-sealed imaging assembly 300 and can thereafter be removed by operation of the anti-biofouling lights. In some embodiments, the removal of the biological organisms can be assisted with water jets or with a wiper mechanism such as shown above in conjunction with FIGS. 4-4C and 9. In some other embodiments the removal of the biological organisms can be assisted by movement through the water.

All references cited herein are hereby incorporated herein by reference in their entirety.

Having described preferred embodiments, which serve to illustrate various concepts, structures and techniques, which are the subject of this patent, it will now become apparent to those of ordinary skill in the art that other embodiments incorporating these concepts, structures and techniques may be used. Accordingly, it is submitted that that scope of the patent should not be limited to the described embodiments but rather should be limited only by the spirit and scope of the following claims.

What is claimed is:

1. A system for anti-biofouling a protected surface disposed upon an object configured to be immersed in water, the system comprising:

an ultraviolet light source operable to generate ultraviolet light;

an optical medium disposed between the protected surface and the object, the optical medium extending parallel to the protected surface, the optical medium coupled to receive the ultraviolet light from the ultraviolet light source, the ultraviolet light directed through the optical medium in one or more directions parallel to the protected surface, wherein the optical medium is operable to allow portions of the ultraviolet light to escape the optical medium at respective portions of the optical medium to expose the protected surface to the ultraviolet light; and a cleaning mechanism proximate to the protected surface, wherein the exposure of the protected surface to the ultraviolet light is operable to facilitate removal of biological material from the protected surface after the protected surface has been exposed to the ultraviolet light.

2. The system of claim 1, wherein the optical medium comprises an optical coating proximate to the protected surface, wherein the optical coating is configured to provide a propagation path for the ultraviolet light.

3. The system of claim 2, wherein the optical coating comprises a urethane acrylate coating.

4. The system of claim 2, wherein the optical coating comprises a Dymax coating.

5. The system of claim 2, wherein the optical coating comprises an amorphous Polytetrafluoroethylene coating.

6. The system of claim 2, wherein the optical coating comprises a Hexafluoropropylene and Vinylidene fluoride (THV) coating.

7. The system of claim 2, wherein the optical coating comprises a Polyether ether ketone (PEEK) coating.

8. The system of claim 2, wherein the optical coating comprises a Fluorinated ethylene propylene (FEP) coating.

9. The system of claim 2, wherein the optical coating comprises an Ethylene Tetrafluoroethylene (ETFE) coating.

10. The system of claim 2, wherein the optical coating comprises a Polymethylpentene (PMP) coating.

11. The system of claim 1, wherein the optical medium comprises one or more optical fibers, each one of the one or more optical fibers configured to carry a respective portion of the ultraviolet light along a length of each one of the one or more optical fibers, wherein a physical characteristic of each one of the one or more optical fibers changes along a length of each one of the one or more optical fibers in a way selected to allow, at any point along a respective length of each one of the one or more optical fibers, a determined percentage of a total power of the ultraviolet light source to escape each respective one of the one or more optical fibers.

12. The system of claim 11, wherein at least one of the one or more optical fibers has a D-shaped cross section.

13. The system of claim 1, wherein the cleaning mechanism comprises a pull wire disposed under a degradable layer.

14. The system of claim 1, wherein the cleaning mechanism comprises a wiper mechanism.

15. The system of claim 1, wherein the cleaning mechanism comprises a water jet mechanism.

16. The system of claim 1, wherein the protected surface comprises:

a degradable layer, wherein the degradable layer is disposed to receive the portions of the ultraviolet light that escape the optical medium, wherein the degradable layer is responsive to the ultraviolet light such that selected portions of the degradable layer are configured to change mechanical properties and to be removable in response to the ultraviolet light, facilitating the removal of the biological material from the protected surface.

17. The system of claim 16, wherein the degradable layer is disposed at a position able to be exposed to the water.

18. The system of claim 16, wherein the selectable portions are removed by the cleaning mechanism after the exposure to the ultraviolet light.

19. The system of claim 16, further comprising a penetrating structure configured to penetrate through the protected surface and operable to carry the ultraviolet light, via the penetrating structure, and to the optical medium, wherein the penetrating structure comprises:

a seal coupled between the penetrating structure and the protected surface; and at least one of:

an optical structure configured to generate the ultraviolet light and to communicate the ultraviolet light to the optical medium, or an optical structure coupled to receive the ultraviolet light and to communicate the ultraviolet light to the optical medium.

20. A method anti-biofouling a protected surface disposed upon an object configured to be immersed in water, comprising:

generating ultraviolet light with an ultraviolet light source;

receiving the ultraviolet light with an optical medium;

with the optical medium, directing the ultraviolet light through the optical medium in one or more directions parallel to the protected surface, the optical medium disposed between the protected surface and the object, the optical medium extending parallel to the protected surface;

with the optical medium, allowing portions of the ultraviolet light to escape the optical medium at respective portions of optical medium to expose the protected surface to the ultraviolet light; and;

providing a cleaning mechanism proximate to the protected surface; and after the protected surface is exposed to the ultraviolet light, using the cleaning mechanism to remove biological material from the protected surface, the exposure of the protected surface to the ultraviolet light operable to facilitate removal.

21. The method of claim 20, further comprising:

with a degradable layer disposed at a position able to be exposed to the water, the degradable layer acting as the protected surface, receiving the portions of the ultraviolet light that escape the optical medium, wherein the degradable layer is responsive to the ultraviolet light such that selected portions of the degradable layer are configured to change mechanical properties and to be removable in response to the ultraviolet light, facilitating the removal of the biological material from the protected surface.

22. The method of claim 20, wherein the optical medium comprises an optical coating proximate to the protected surface, wherein the optical coating is configured to provide a propagation path for the ultraviolet light.

23. The method of claim 20, wherein the optical medium comprises one or more optical fibers, each one of the one or more optical fibers configured to carry a respective portion of the ultraviolet light along a length of each one of the one or more optical fibers, wherein a physical characteristic of each one of the one or more optical fibers changes along a length of each one of the one or more optical fibers in a way selected to allow, at any point along a respective length of each one of the one or more optical fibers, a determined percentage of a total power of the ultraviolet light source to escape each respective one of the one or more optical fibers.

24. The method of claim 23, wherein at least one of the one or more optical fibers has a flat region extending along a length of the at least one of the one or more optical fibers.

25. The method of claim 20, further comprising:

providing a degradable layer as the protected surface;

with the degradable layer, receiving the portions of the ultraviolet light that escape the optical medium, wherein the degradable layer is responsive to the ultraviolet light such that selected portions of the degradable layer are configured to change mechanical properties and to be removable in response to the ultraviolet light, facilitating the removal of the biological material from the protected surface.

* * * * *